US005964459A

United States Patent [19]

Yamanaka

[11] Patent Number: 5,964,459

[45] **Date of Patent: *Oct. 12, 1999**

[54] SHEET-BUNDLE CONVEYING APPARATUS

[75] Inventor: Yuji Yamanaka, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/777,176

[22] Filed: Dec. 27, 1996

[30] Foreign Application Priority Data

Jan. 9, 1996 [JP] Japan ..... 8-001749

[51] Int. Cl.[6] ..... B65H 31/34

[52] U.S. Cl. ..... 270/58.08; 270/58.16

[58] Field of Search ..... 270/58.12, 58.16, 270/58.07, 58.17, 58.08

[56] References Cited

U.S. PATENT DOCUMENTS 4,073,391 2/1978 O'Brien et al. ..... 270/58.17
5,044,625 9/1991 Reid ..... 270/58.16
5,169,134 12/1992 Ishiguro et al. ..... 270/58.16
5,288,062 2/1994 Rizzolo et al. ..... 270/58.12
5,338,017 8/1994 Stemmle ..... 270/58.08
5,524,873 6/1996 Hosoi et al. ..... 270/58.16
5,540,421 7/1996 Ohta et al. ..... 270/58.19
5,569,011 10/1996 Yamaguchi et al. ..... 412/9
5,569,012 10/1996 Kousa et al. ..... 412/33
5,634,632 6/1997 Furuya et al. ..... 270/58.12

*Primary Examiner*—John Kwon
*Attorney, Agent, or Firm*—Fitzpatrick, Cella, Harper & Scinto

[57] ABSTRACT

A sheet-bundle conveying apparatus includes a shift tray on which a sheet-bundle is rested and which is shifted laterally, a container for containing the sheet-bundle shifted by the shift tray, and a shift means for changing a relative position between the shift tray and the sheet-bundle rested on the shift tray so that the sheet-bundle is shifted toward the container. The shift tray is shifted toward the containing means while shifting the sheet-bundle in this way, thereby causing the sheet-bundle to reach the containing means.

20 Claims, 22 Drawing Sheets

SHEET-BUNDLE CONVEYING APPARATUS

BACKGROUND OF THE INVENTION

1. Field of the Invention

The present invention relates to a sheet-bundle conveying method, a sheet-bundle conveying apparatus used in such a sheet-bundle conveying method, and a bookbinding apparatus having such a sheet-bundle conveying apparatus. More particularly, it relates to a sheet-bundle conveying method, a sheet-bundle conveying apparatus used in such a sheet-bundle conveying method, and a bookbinding apparatus having such a sheet-bundle conveying apparatus, in which, after output sheets are book-bound, the book-bound sheet-bundle is conveyed.

2. Related Background Art

In conventional bookbinding apparatuses for an image forming apparatus such as a printer, a sheet-bundle conveying means served to convey a sheet bundle comprised of imaged sheets from an alignment portion to a bookbinding portion and then from the bookbinding portion to a containing portion. In particular, a shiftable tray for conveying and containing the sheet-bundle to the containing portion was bulky for maintaining a large shifting amount of the tray and for ensuring the rigidity of the tray.

SUMMARY OF THE INVENTION

The present invention aims to eliminate the abovementioned conventional drawback, and an object of the present invention is to provide an improved sheet-bundle conveying method, and an improved sheet-bundle conveying apparatus which is cheap and compact.

Another object of the present invention is to provide a bookbinding apparatus which can improve bookbind working ability.

To achieve the above object, the present invention is characterized by a shift tray on which a sheet-bundle is rested and which can be shifted laterally, a containing means for containing the sheet-bundle shifted by the shift tray, a shift means for changing a relative position between the shift tray and the sheet-bundle rested on the shift tray in such a manner that the sheet-bundle is shifted toward the containing means. Also, the shift tray is shifted toward the containing means while shifting the sheet-bundle in this way, to enter the sheet-bundle into the containing means.

Further, the present invention provides a sheet-bundle conveying method wherein a shift tray on which a sheet-bundle was rested is shifted laterally from a resting position to a containing position to enter the sheet-bundle into a stacker, and is lowered to a stack position, and then is shifted laterally in an opposite direction, thereby resting the sheet-bundle in the stacker. It comprises the steps of restraining the sheet-bundle while the shift tray is being shifted laterally, temporarily returning the shift tray laterally in the opposite direction, relatively shifting the sheet-bundle on the shift tray outward the containing position, and shifting the shift tray laterally until the sheet-bundle enters into the stacker.

The present invention can similarly be applied to a bookbinding apparatus in which successively supplied sheets are book-bound and which comprises a sheet-bundle conveying apparatus for conveying a book-bound sheet-bundle and a containing portion for containing the sheet-bundle.

As mentioned above, in the sheet-bundle conveying method and apparatus according to the present invention, since the sheet-bundle is shifted to the containing portion and is contained therein with out-of-phase between the sheet-bundle and the tray, the sheet-bundle can be shifted by a distance more than a shifting amount of the tray, with the result that the lateral shift tray can be made compact, installation space of the apparatus can be saved, and the apparatus can be made cheaper. In other words, since the shifting amount of the sheet-bundle can be increased without increasing the length of the shift tray, the apparatus can be made compact. Further, by abutting the sheet-bundle against the abutment member, the positional deviation of the sheet-bundle can be corrected, thereby achieving the stable sheet-bundle conveyance.

DETAILED DESCRIPTION OF THE PREFERRED EMBODIMENTS

Figure 1:
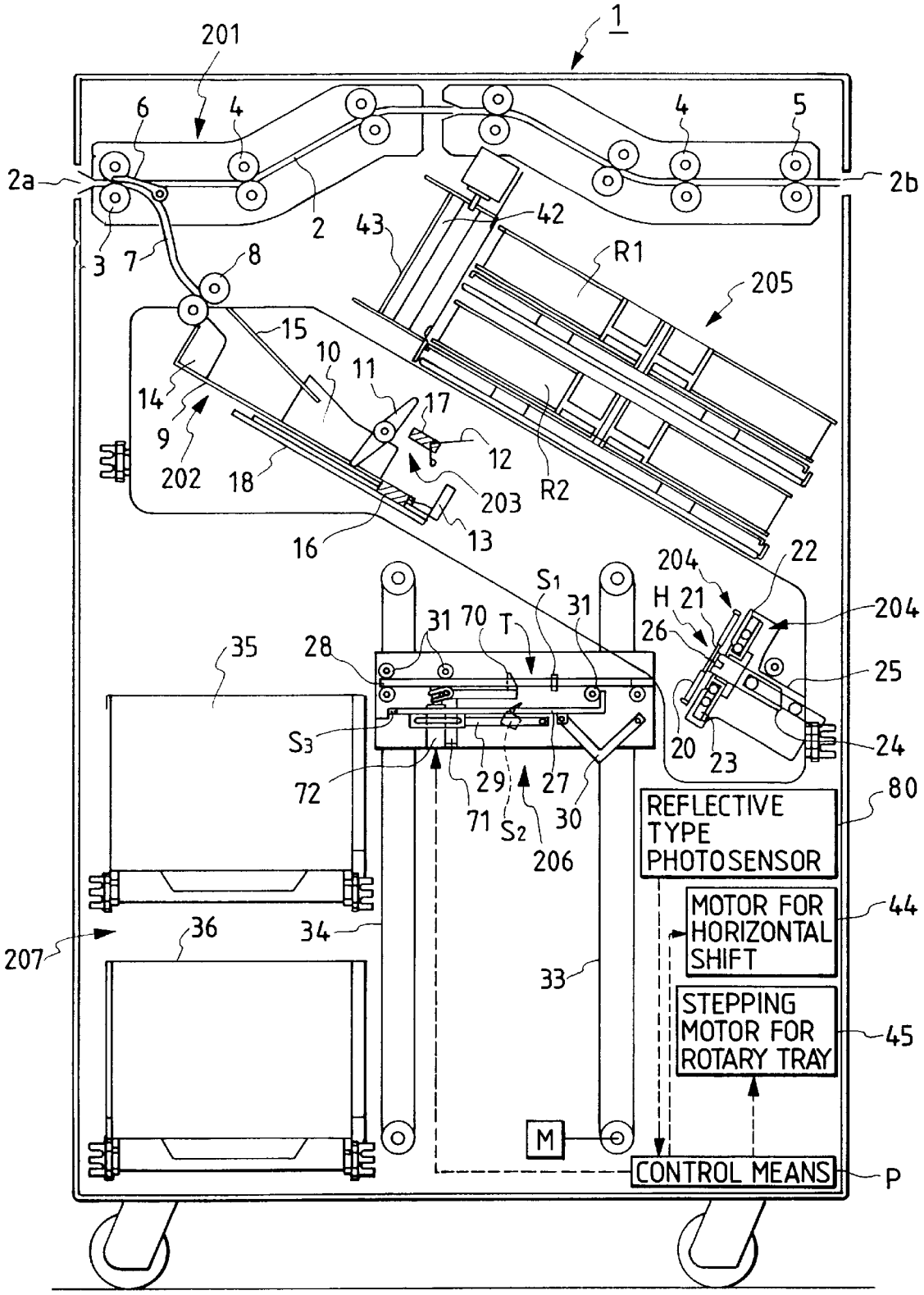
FIG. 1 is an elevational sectional view of a bookbinding apparatus according to a first embodiment of the present invention.

A bookbinding apparatus according to the present invention will now be explained with reference to FIGS. 1 to 8A, 8B and 8C.

A bookbinding apparatus 1 comprises a sheet conveying apparatus 201, a sheet aligning apparatus (alignment means) 202, a sheet-bundle shifting means (gripper) 203, a tape heating apparatus (bookbinding portion) 204, a tape conveying apparatus 205, a book-bound bundle conveying apparatus (sheet-bundle conveying apparatus) 206, and a containing stacker (containing portion) 207.

The sheet conveying apparatus 201 has a convey path 2 for a sheet S to be supplied, which convey path includes an inlet 2*a* and an outlet 2*b*. Along the sheet convey path 2, from an upstream side to a downstream side thereof, there are provided a pair of convey-in rollers 3, a plurality of pairs of convey rollers 4, and a pair of convey-out rollers 5. In the vicinity of the pair of convey-in rollers 3, at a downstream side thereof, there is provided a flapper (branch means) 6 so that, when the sheets are book-bound, the sheet convey path 2 is switched to a sheet convey path 7.

The sheet S introduced into the sheet convey path 7 by means of the flapper 6 is conveyed to the sheet aligning apparatus 202 by a pair of sheet convey rollers 8. The sheet aligning apparatus 202 comprises a containing tray 9 (FIG. 2) for containing the sheets, an alignment fence 10 for aligning lateral edges (parallel to a sheet conveying direction) of the sheets with each other, an alignment paddle 11 for aligning tip ends of the sheets with each other, a stop finger 12 for temporarily stopping the sheets for a sheet-bundle, a tip end reference shutter 13 against which the tip ends of the sheets abut, an inlet lower guide 14 for guiding a lower surface of the sheet at an inlet of the apparatus, and an inlet upper guide 15 for guiding an upper surface of the sheet at the inlet of the apparatus. The sheet S introduced into the sheet aligning apparatus 202 is urged against the tip end reference shutter 13 (13*a*, 13*b*) (FIG. 2) while guiding the upper surface by the inlet upper guide 15 (15*a*, 15*b*, 15*c*) and the lower surface by the inlet lower guide 14. In this case, on the containing tray 9, the sheets are aligned with each other by the alignment paddle 11 in the sheet conveying direction and the lateral edges of the sheets are aligned with each other by the alignment fence 10. The alignment fence 10 comprises a fixed fence 10*a* and a movable fence 10*b* so that the sheets are aligned by using the fixed fence 10*a* as a reference. When the bookbinding operation is effected continuously, the stop finger 12 (12*a*, 12*b*) is operated to temporarily stop the sheets for a next sheet-bundle, and, after the aligned sheet-bundle leaves the containing tray 9, the stop finger 12 (12*a*, 12*b*) is released to transfer the sheets to the containing tray 9.

Figure 2:
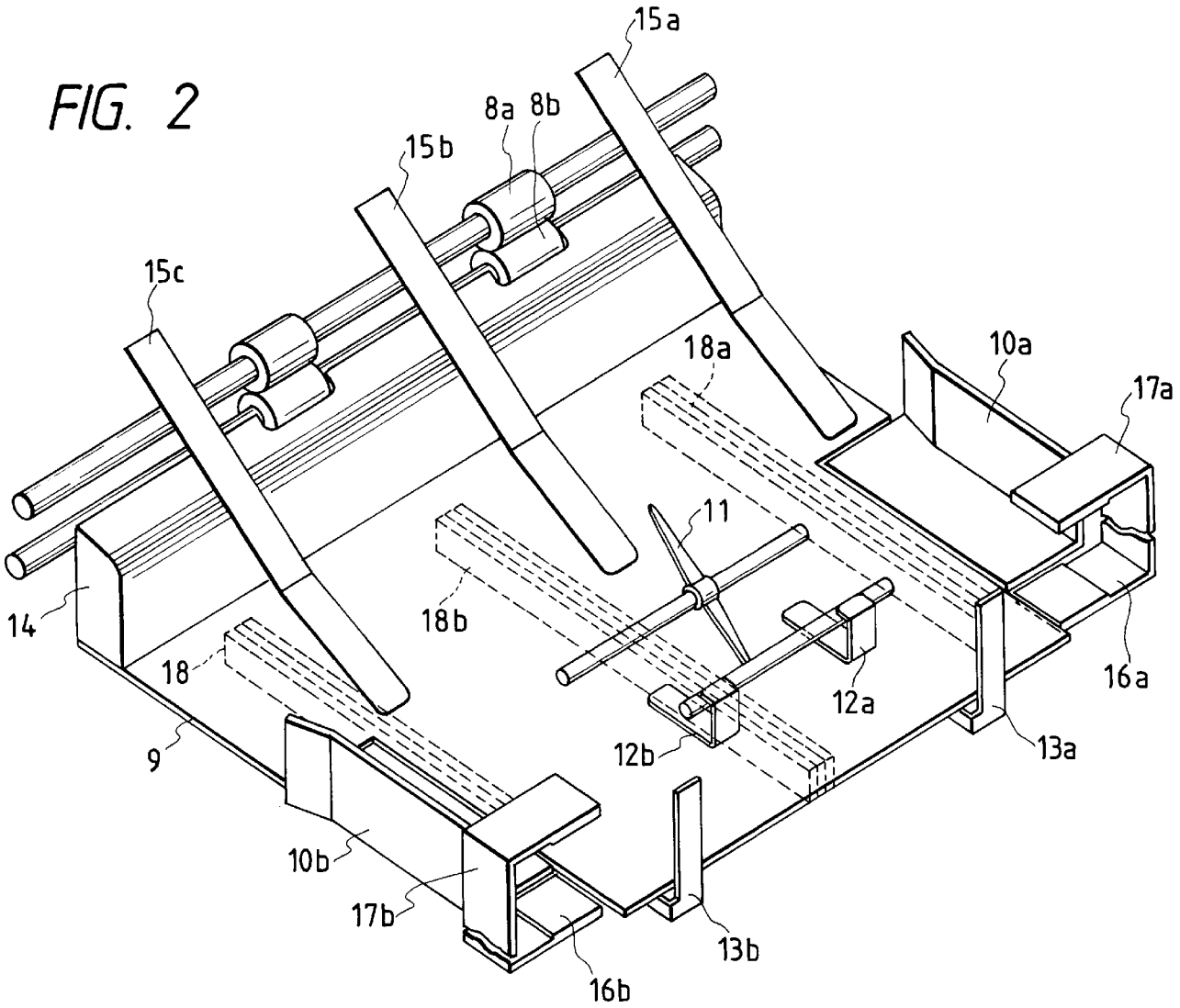
FIG. 2 is a perspective view for explaining a sheet aligning apparatus.

The sheet-bundle shifting means 203 is constituted by a movable grip plate 17 (17*a*, 17*b*), a fixed grip plate 16, a grip drive mechanism (not shown) for the movable grip plate 17, a shifting mechanism (not shown) for the movable and fixed grip plates 17, 16, and a sheet-bundle guide 18 (FIG. 2).

Figure 3A:
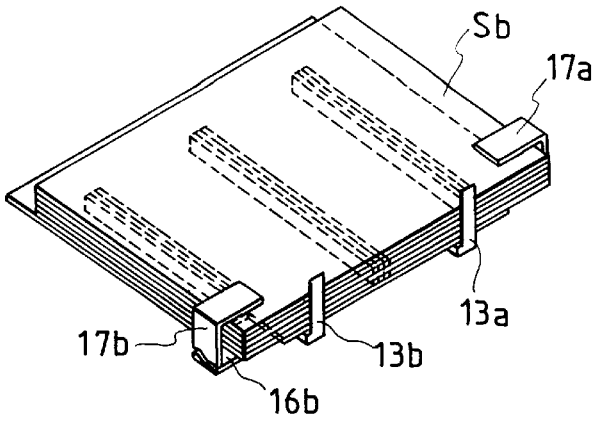
FIGS. 3A, 3B and 3C and FIGS. 4A, 4B and 4C are perspective views for explaining an operation of a sheet-bundle conveying means.
Figure 3B:
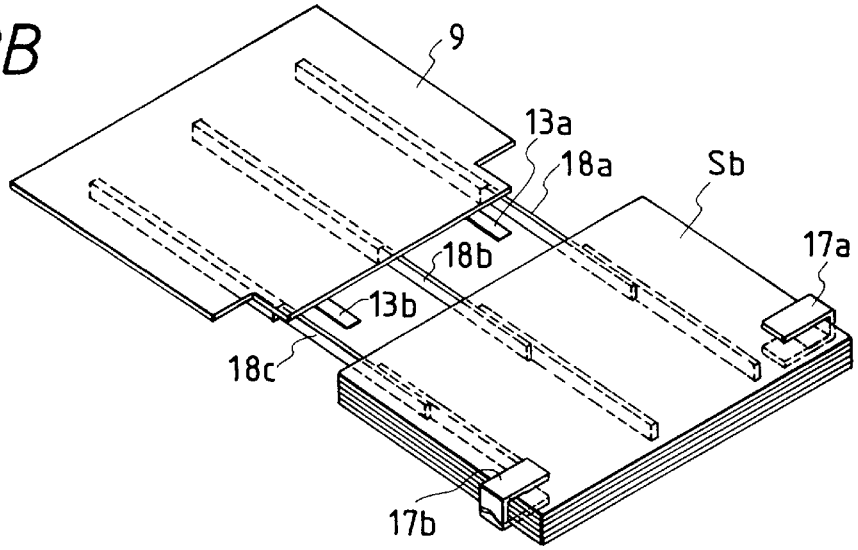
Figure 3C:
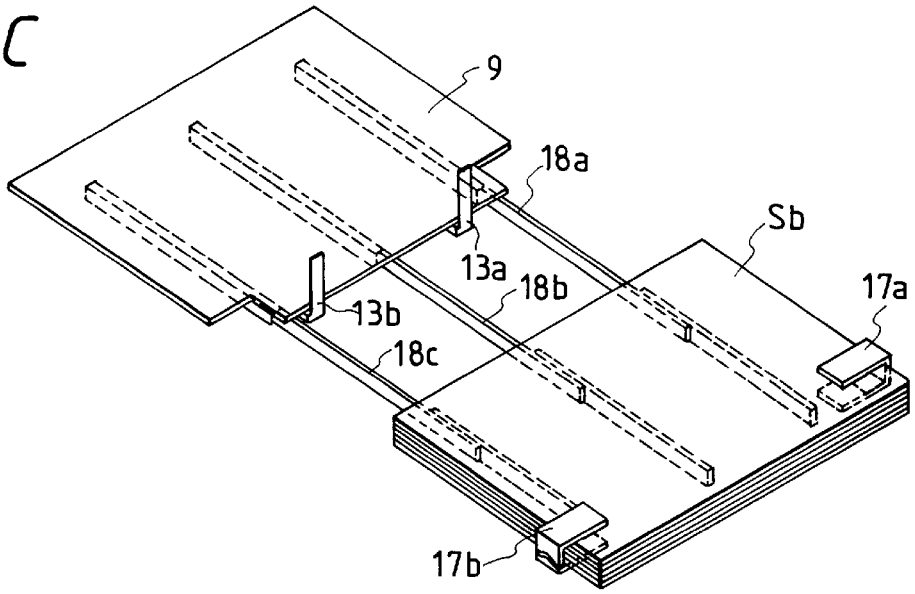

When the alignment of the sheets in the sheet aligning apparatus 202 is completed, the grip drive mechanism (not shown) for the movable grip plate 17 is operated, with the result that the movable grip plate 17 is shifted to pinch the aligned sheet-bundle between this grip plate and the fixed grip plate 16 (FIG. 3A). When the gripping of the sheet-bundle is completed, the shifting mechanism (not shown) for the movable and fixed grip plates 17, 16 is operated, with the result that the aligned sheet-bundle is conveyed from the sheet aligning apparatus 202 to the tape heating apparatus 204 while gripping the sheet-bundle (FIG. 3B). In this case, a lower portion of a rear end of the sheet-bundle is guided and supported by the sheet-bundle guide 18 (18*a*, 18*b*, 18*c*). Further, in this case, the sheet-bundle guide 18 is shifted together with the movable grip plate 17 and the fixed grip plate 16.

The tape heating apparatus 204 comprises tape guides 19, 20, a center heater 21, side heaters 22, 23, a drive mechanism 24 for the center heater 21, and a drive mechanism 25 for the side heaters 22, 23 (FIG. 1). A bind tape 26 is supplied to the tape guides 19, 20 of the tape heating apparatus 204 by means of the tape conveying apparatus 205 before the aligned sheet-bundle is conveyed to the tape heating apparatus by means of the sheet-bundle shifting means 203.

Figure 5:
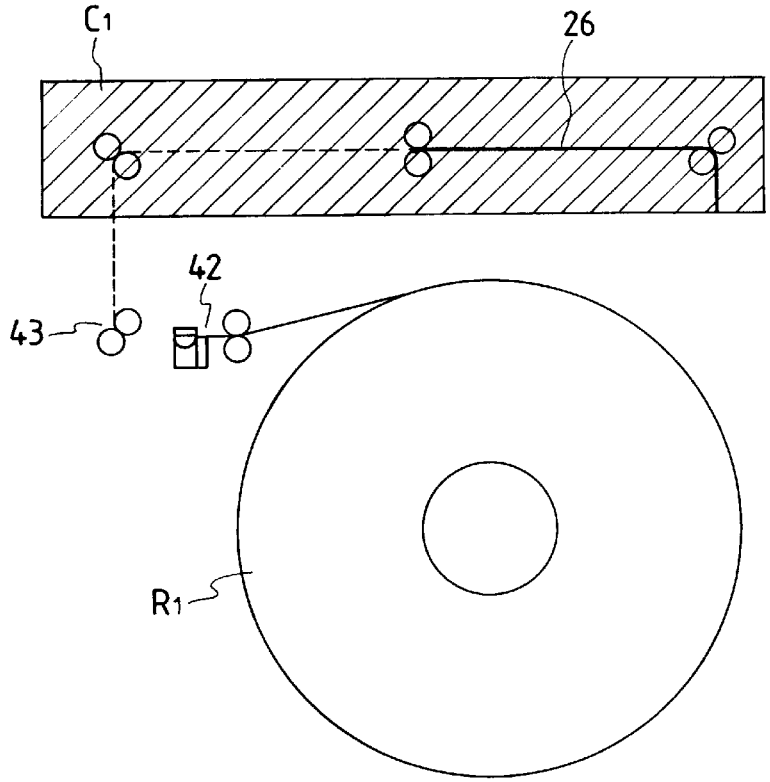
FIG. 5 is a top view for explaining a tape conveying device.
Figure 7:
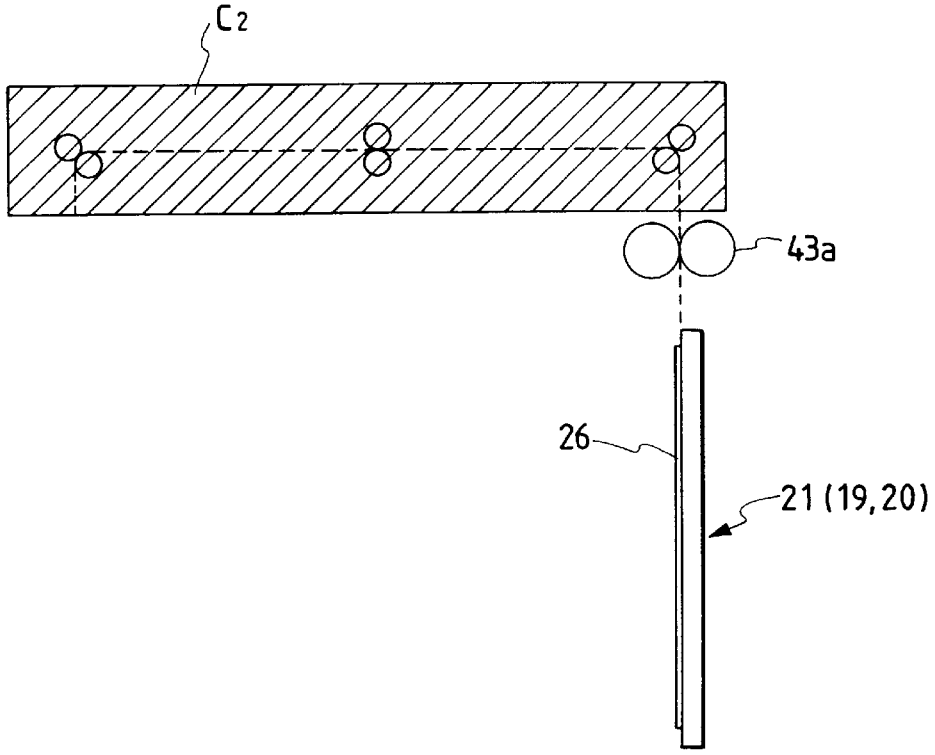
FIG. 7 is a front sectional view for explaining a bind tape supplying condition.
Figure 6:
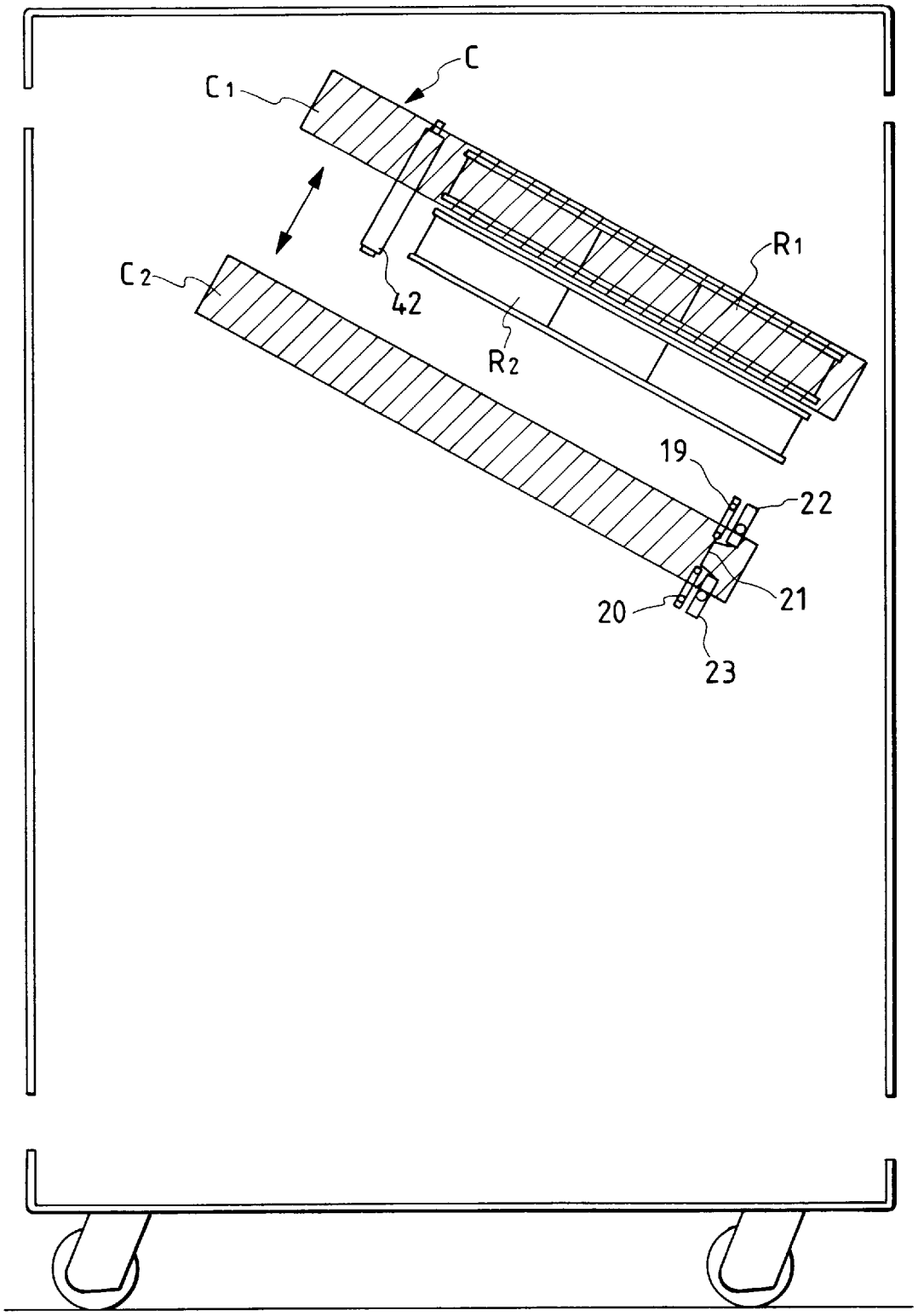
FIG. 6 is a side sectional view of the tape conveying device.

The tape conveying apparatus 205 comprises tape reels R1, R2, a carriage conveyer C, a tape cutter 42, and tape conveying means 43, 43*a* (FIG. 1). The tape wound around the tape reel R1 or R2 is cut to a predetermined length (bind tape 26) by the tape cutter 42 and then is conveyed into the carriage conveyer C by the tape conveying means 43 (FIG. 5). When the bind tape 26 is conveyed to the carriage conveyer C by means of the tape conveying means 43, the carriage conveyer C is shifted from a tape receiving position C1 to a tape transferring position C2 (FIG. 6). When the shifting movement of the carriage conveyer C from the tape receiving position C1 to the tape transferring position C2 is completed, the bind tape 26 is supplied to the tape guides 19, 20 by the tape conveying means 43*a* (FIG. 7). After the bind tape 26 is supplied, the center heater 21 is shifted from a retard or retract position (not shown) to a heating position (FIG. 1) by the drive mechanism 24 for the center heater 21, thereby starting the pre-heating of the bind tape 26.

When the aligned sheet-bundle is conveyed to a back surface abutment position H by the sheet-bundle conveying apparatus 203 (FIG. 3C), the back surface of the sheet-bundle is bound.

Figure 4A:
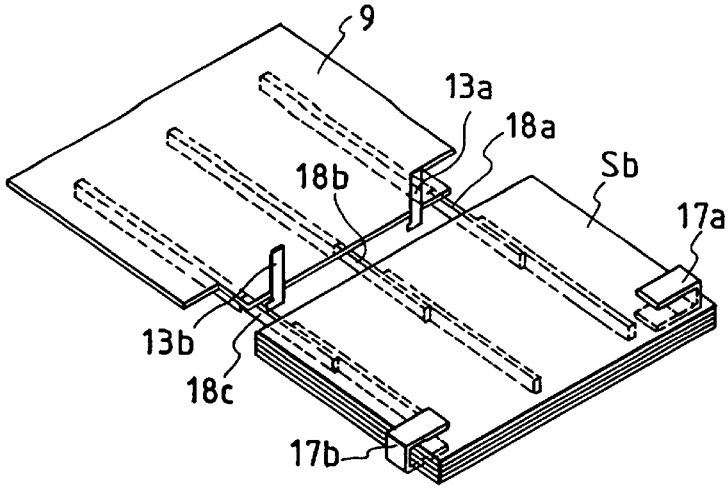
Figure 4B:
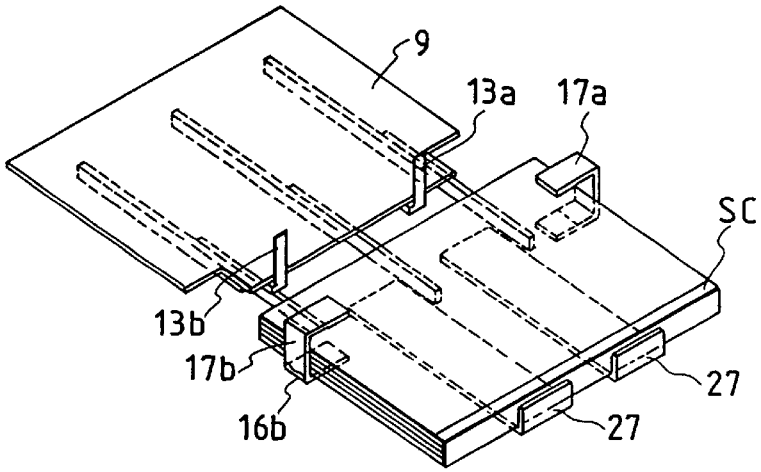
Figure 4C:
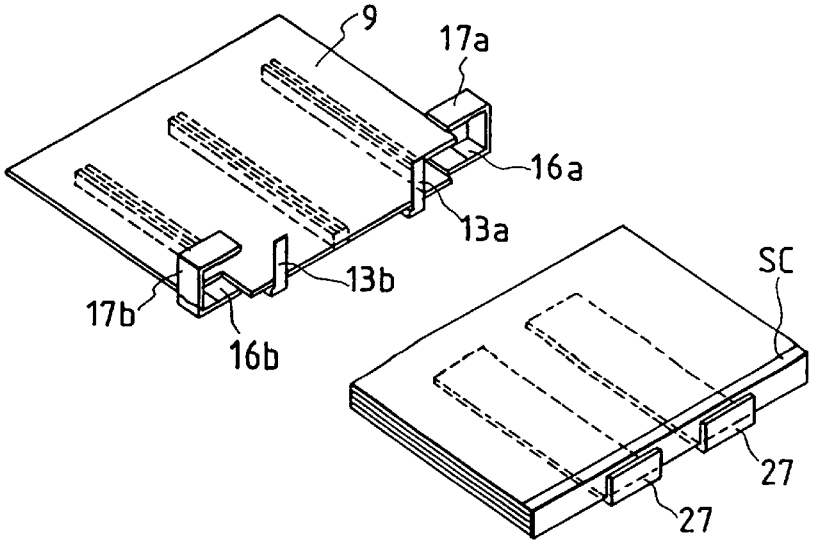

When the binding of the back surface of the sheet-bundle is completed, the side heaters 22, 23 are shifted by the drive mechanism 25 to lift the ends of the bind tape 26 while retarding or retracting the tape guides 19, 20 to a retard position (not shown), with the result that the binding of the sides of the sheet-bundle is started while pinching the sheet-bundle Sb between the side heaters 22, 23. When binding of the sides of the sheet-bundle is completed, the pressurization of the side heaters 22, 23 is released. When the pressurization of the side heaters 22, 23 is released, the book-bound sheet-bundle SC is shifted by the sheet-bundle conveying apparatus 203 from the back surface abutment position to a transferring position to the book-bound bundle conveying apparatus 206 (FIG. 4D). The center heater 21 and the side heaters 22, 23 are returned to their retard positions by the drive mechanism 24 for the center heater 21 and the drive mechanism 25 for the side heaters 22, 23, where a next bind tape is supplied to the heaters.

Figure 9:
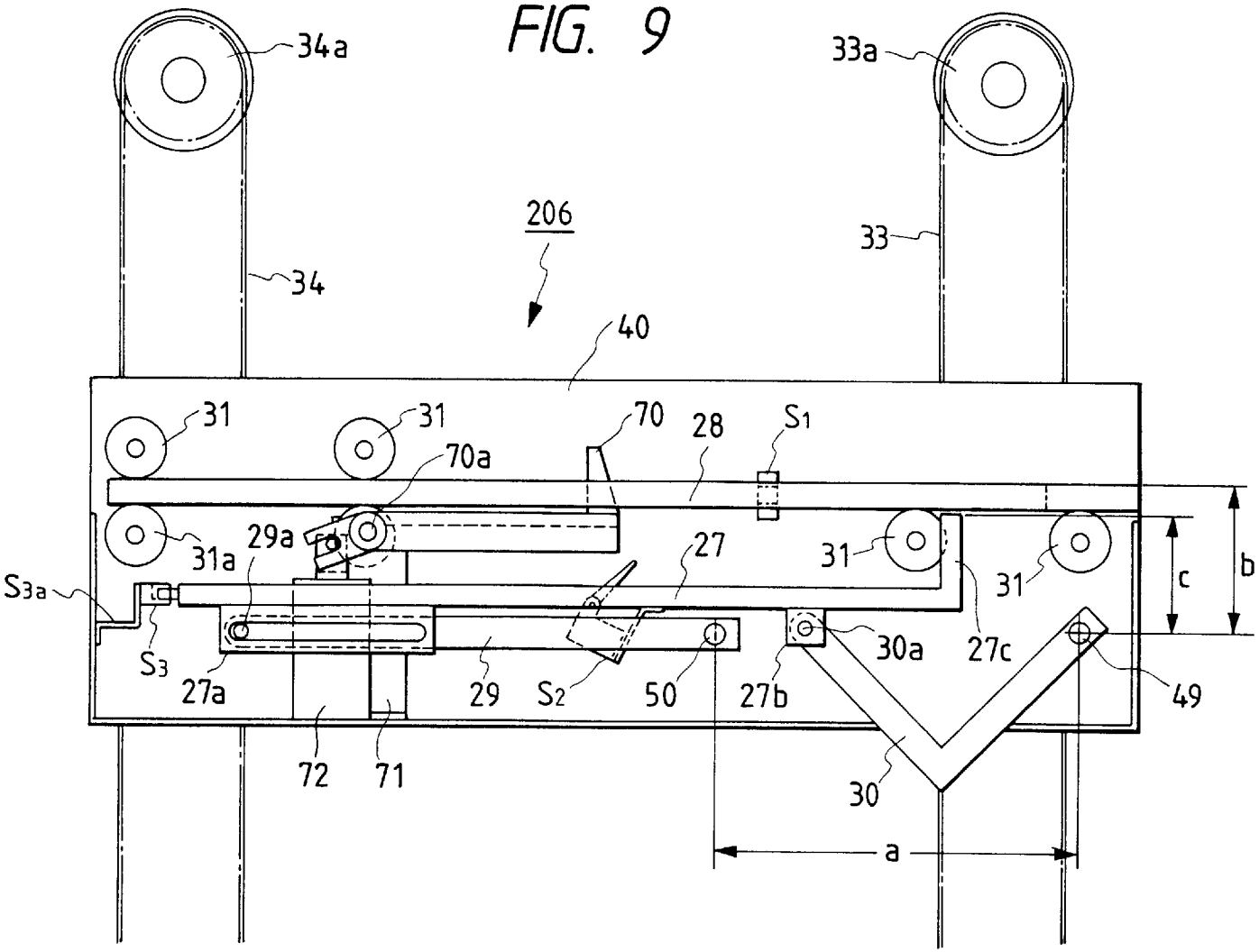
FIG. 9 is an enlarged front view of a book-bound bundle conveying apparatus as a sheet-bundle conveying apparatus.

The book-bound bundle conveying apparatus 206 comprises a first tray or horizontal shift tray (lateral shift tray) 28, a second tray or rotation tray (rock tray) 27, drive links 29, 30 for the rotation tray 27, a drive means 31 for the horizontal shift tray 28, and lift/lower means 33, 34 (FIG. 9).

When the book-bound sheet-bundle SC is shifted by the sheet-bundle conveying apparatus 203 from the back surface abutment position to the transferring position to the book-bound bundle conveying apparatus 206, the rotation tray 27 is shifted to a book-bound sheet-bundle receiving position by the drive links 29, 30 (FIG. 9). When the shifting movement of the rotation tray 27 to the book-bound sheet-bundle receiving position is completed, the gripping of the movable grip plate 17 and the fixed grip plate 18 of the sheet-bundle conveying apparatus 203 is released, with the result that the book-bound sheet-bundle SC is received by the rotation tray 27. The sheet-bundle conveying apparatus

203 is returned to the aligned sheet-bundle pinching position of the sheet aligning apparatus 202 (FIG. 4E). When the rotation tray 27 receives the book-bound sheet-bundle SC (FIG. 4F), the rotation tray is shifted to a transferring position T to the horizontal shift tray 28 by means of the drive links 29, 30 (FIG. 1).

Figure 8A:
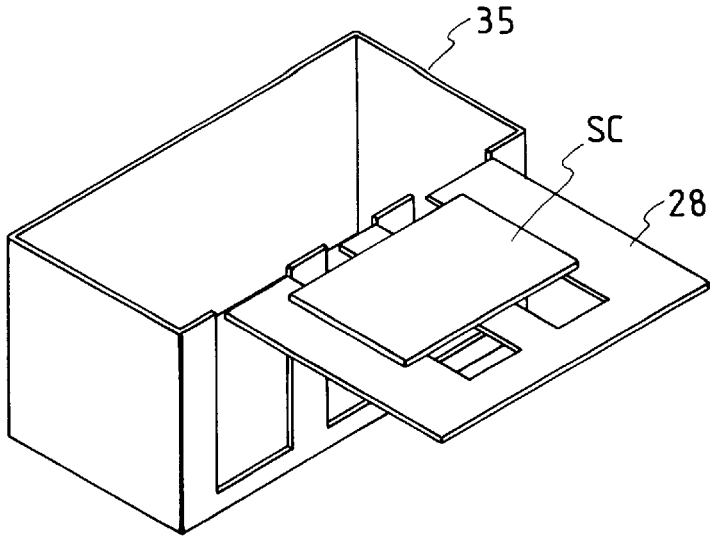
FIGS. 8A, 8B and 8C are perspective views for explaining a condition that a sheet-bundle is contained in a stacker by shifting a horizontal shift tray.
Figure 8B:
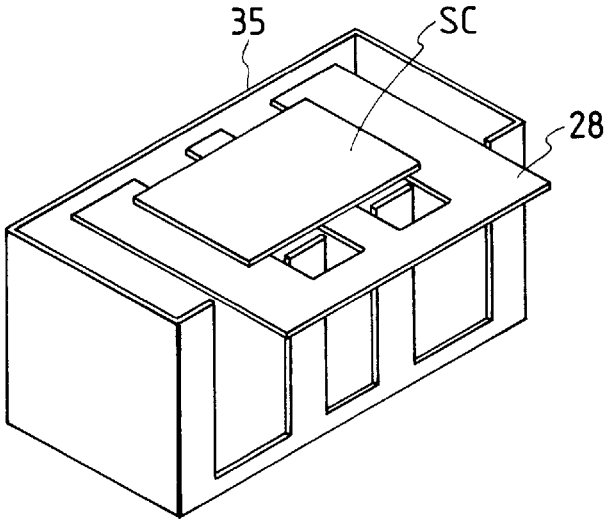
Figure 8C:
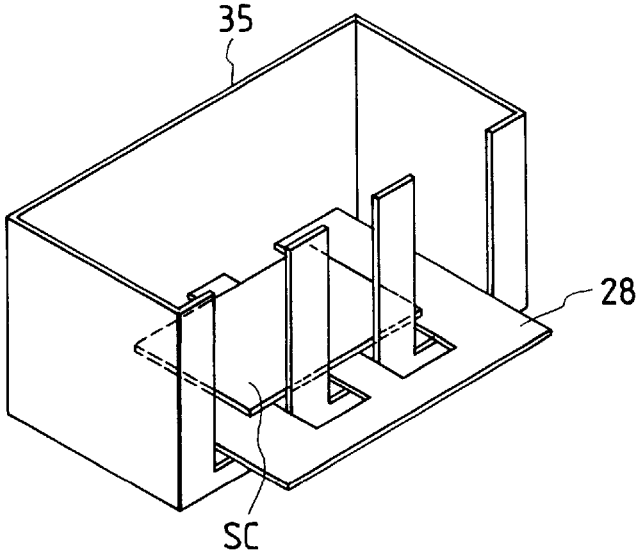

When the book-bound sheet-bundle SC is received by the horizontal shift tray 28 at the transferring position T, the horizontal shift tray is shifted above a containing stacker (containing means) 35 by the drive means 31 (FIG. 8A), and the book-bound sheet-bundle is lowered within the containing stacker 35 by means of the lift/lower means 33, 34 (FIG. 8B). Then, by the movement of the horizontal shift tray 28 away from the containing stacker 35, the book-bound sheet-bundle SC is contained in the containing stacker 35.

Next, a construction and an operation of the book-bound bundle conveying apparatus 206 will be explained with reference to FIGS. 9 to 19.

The book-bound bundle conveying apparatus 206 comprises a frame 40 suspended from four timing belts 33, 34, belt fixing plates 33*b*, 34*b* for connecting the timing belt 33, 34 to the frame 40, a home position sensor S1 for detecting a home position of the horizontal shift tray 28, a home position sensor S3 for detecting a home position of the rotation tray 27, a sensor support S3*a* to which the home position sensor S3 is attached, a book-bound bundle presence/absence sensor S2, the rotation tray 27 having an abutment portion 27*c* against which the book-bound sheet-bundle abuts, the drive links 29, 30, and connecting portions 27*a*, 27*b* of the drive links 29, 30. Incidentally, the connecting portion 27*a* is provided at both of its sides with slide slots into which a slide shaft 29*a* is slidably received.

According to the illustrated embodiment, two rotation trays 27 are provided in a parallel relation, and a distance between the trays is smaller than a width of the book-bound sheet-bundle SC. The drive link 30 has a bent portion bent at 90 degrees. This is the reason why, when the drive link 30 is rotated (in a clockwise direction) to reach an uppermost position (FIG. 12), the interference between the drive link and the horizontal shift tray 28 is avoided.

The drive links 29, 30 are secured to drive shafts 50, 49, respectively. A rotational force of a stepping motor (drive means) 45 is transmitted through gears 46, 47, 47*a*, 48, 48*a*, thereby rotating the drive shafts 50, 49 by a predetermined amount (FIG. 1). The drive shafts 50, 49 are supported by shaft support plates 52, 51 via bearings.

Figure 10:
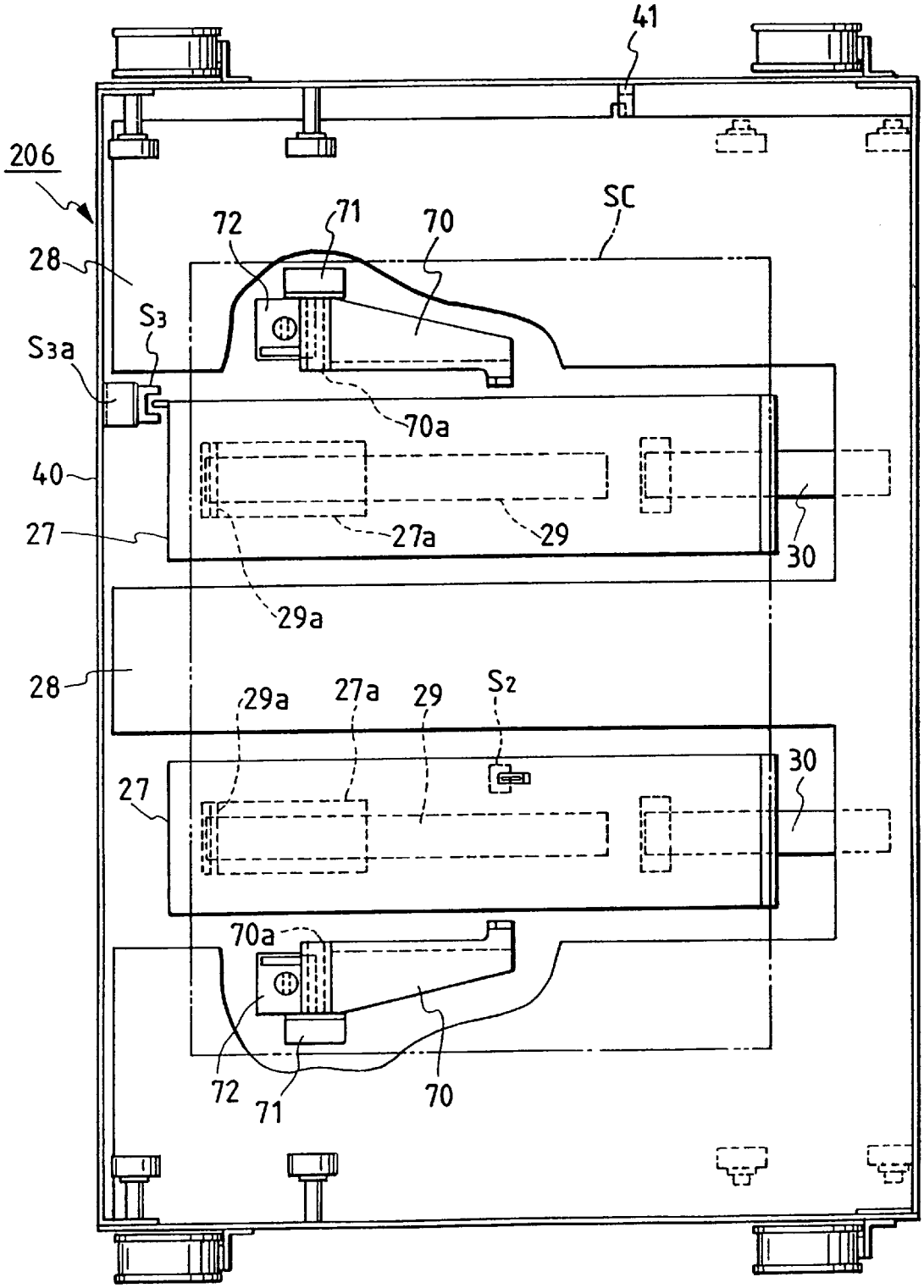
FIG. 10 is a top view of the book-bound bundle conveying apparatus.
Figure 11:
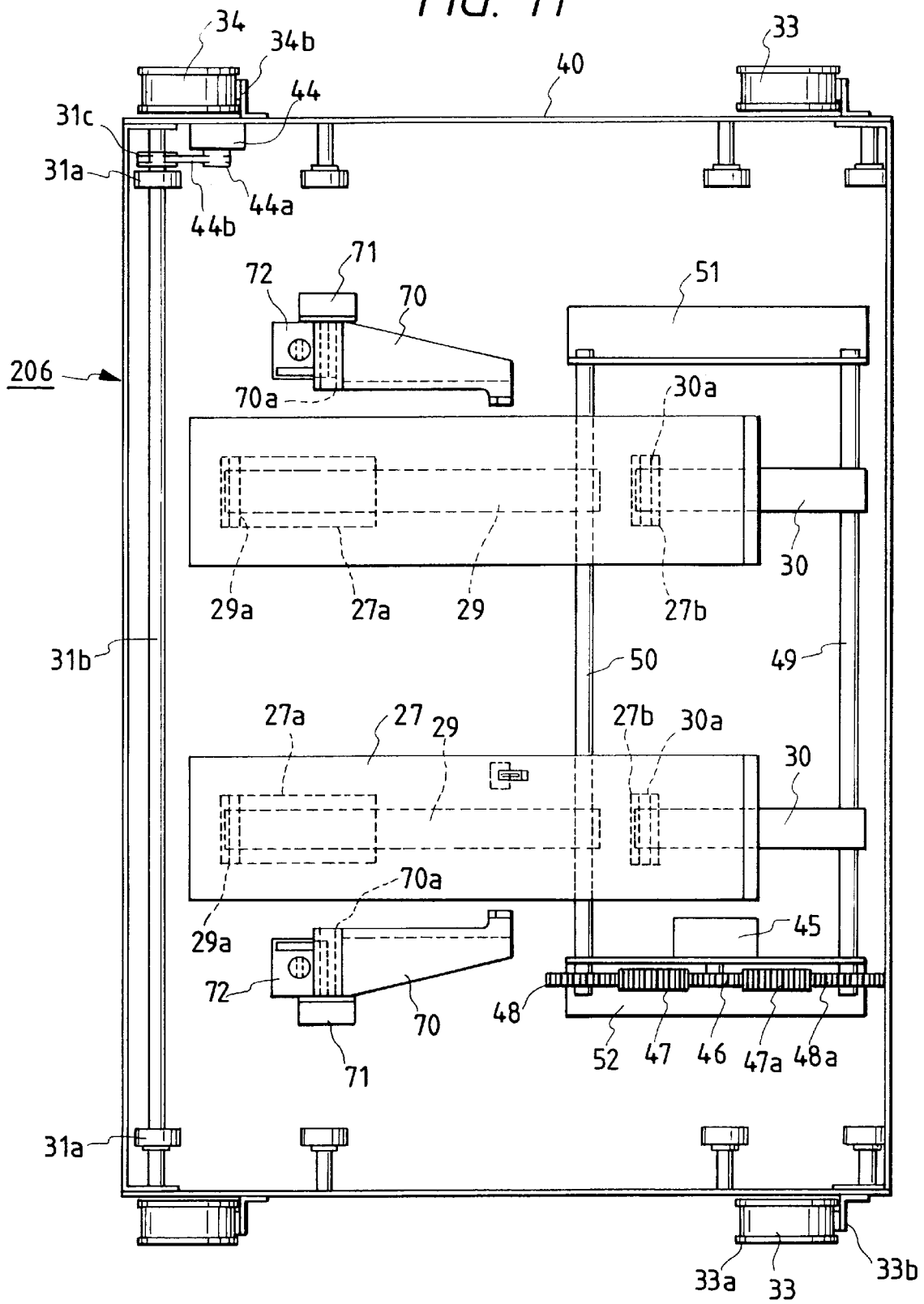
FIG. 11 is a top view for explaining a rotation tray.

The horizontal shift tray 28 has a comb shape (FIGS. 8A, 8B and 8C) so that the rotation trays 27 are received within two spaces (FIG. 10). The horizontal shift tray 28 is supported by rollers 31 and is driven by a drive roller 31*a* which is formed on a through shaft 31*b*. The drive roller 31*a* is driven by a rotational force of a motor (drive means) 44 transmitted through pulleys 44*a*, 31*c* and a timing belt 44*b*. Incidentally, the motor 44 and the stepping motor 45 are controlled by a control means P (FIG. 1).

Figure 12:
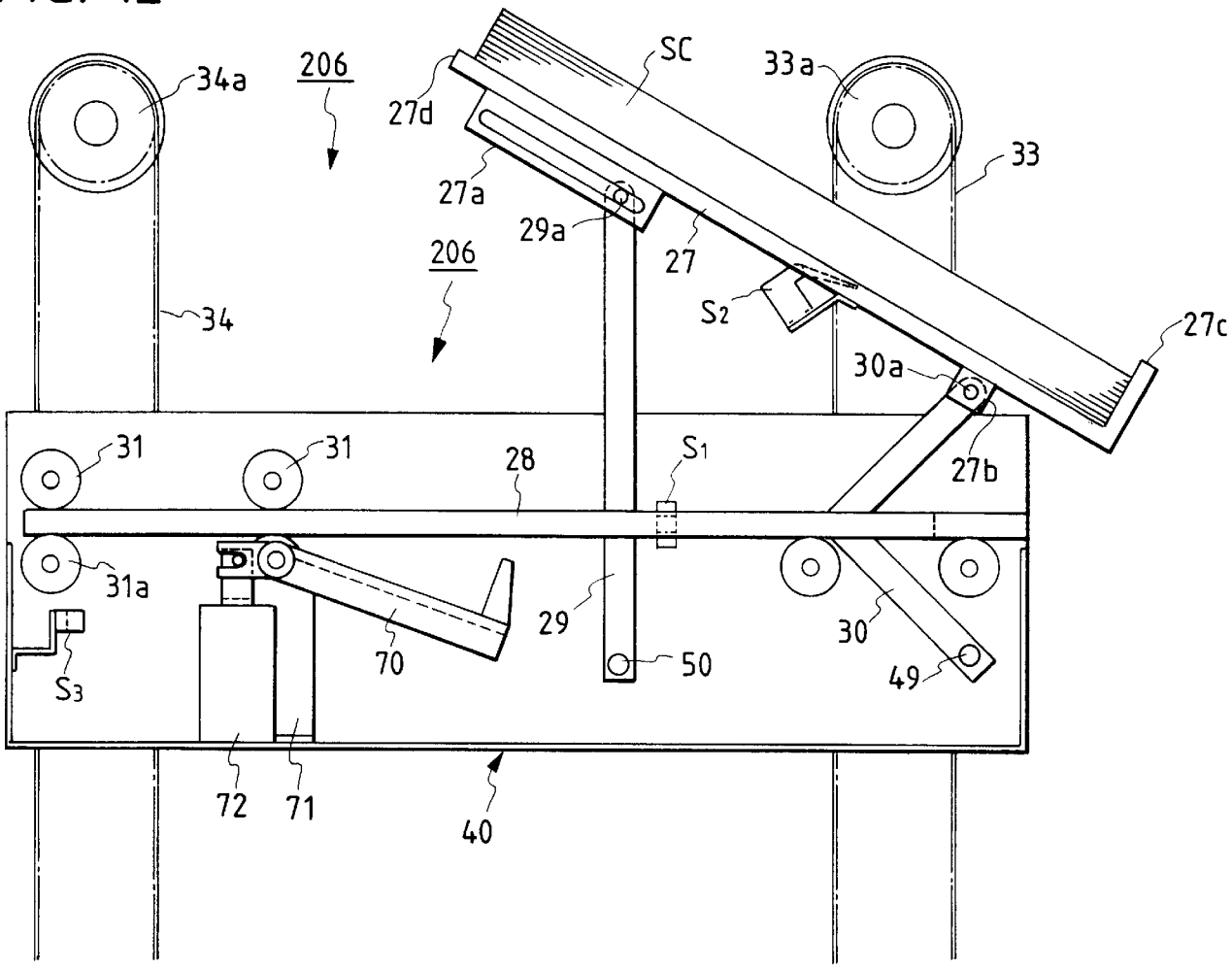
FIGS. 12 and 13 are front views for explaining an operation of the rotation tray.

According to the illustrated embodiment, the drive roller 31*a* is formed from a rubber roller. A distance (a) between the drive shafts 49, 50 is about 95 mm (FIG. 9) in a flat plane. Further, a distance (b) from the drive shaft 49, 50 to the horizontal shift tray 28 is 38 mm, a height (c) of the abutment portion 27*c* above the drive shaft 49 is 30 mm. On the basis of the shaft-to-shaft distance (a) and the lengths of the links, when the drive shafts 49, 50 are rotated at the same speed, the rotation trays 27 are inclined by 30 degrees in a clockwise direction from the horizontal condition, thereby lifting the rotation trays, as shown in FIG. 12 (the rotation trays are lifted by about 70 mm at the connecting portion 27*b*).

Abutment means (step means) 70 are pivotally mounted on a respective support plate 71 via pivot pins 70*a* and, as shown in FIG. 10, two abutment means are disposed between the horizontal shift tray 28 and the rotation trays 27. The abutment means 70 are driven by a solenoid 72 controlled by the control means P (FIGS. 1 and 9).

Next, the function of the illustrated embodiment will be explained.

The book bound sheet-bundle SC is waiting at the transferring position by means of the sheet-bundle conveying apparatus 203 (FIG. 4D). Then, the book-bound bundle conveying apparatus 206 is lifted from the home position (FIG. 1) by 50 mm, thereby reaching the vicinity of the transferring position. Then, the rotation trays 27 reach the transferring position by rotating the drive shafts 49, 50 by 90 degrees by means of the stepping motor 45. In this case, the bundle presence/absence detection sensor S2 is operated by the book-bound sheet-bundle SC. After the presence of the book-bound sheet-bundle SC is confirmed, the sheet-bundle conveying apparatus 203 releases the pinching of the book-bound sheet-bundle SC and is returned to the aligned sheet gripping position (FIGS. 4E and 4F). In this case, since the book-bound sheet-bundle SC is transferred while the lower surface of the bundle is being supported on the rotation trays 27, the book-bound sheet-bundle is not disordered (FIG. 12).

Figure 13:
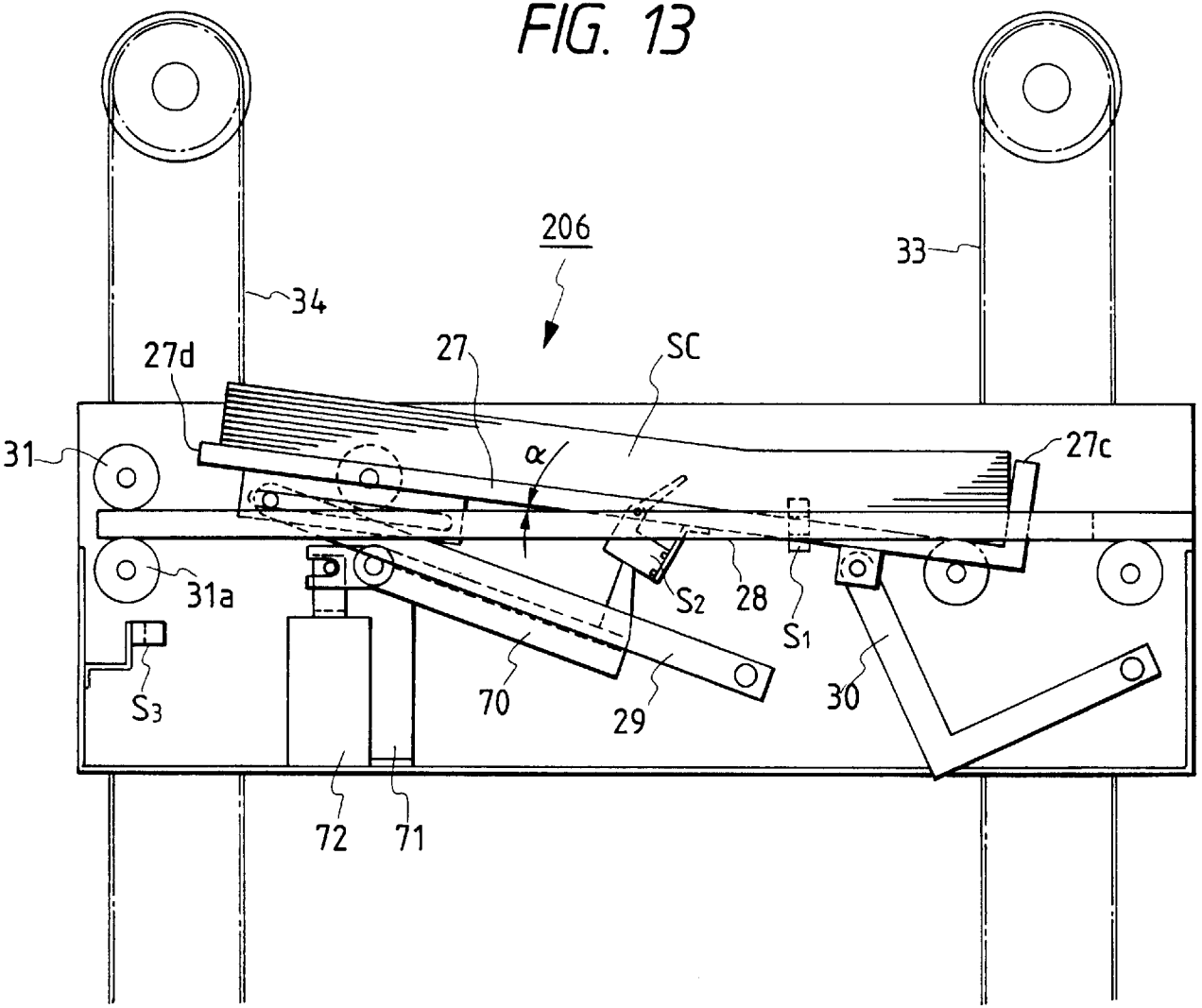

After the sheet-bundle conveying apparatus 203 reaches the aligned sheet gripping position, the stepping motor 45 is rotated in a reverse direction to lower the rotation tray 27 on which the book-bound sheet-bundle SC was rested. In this case, as shown in FIG. 13, when the rotation trays 27 pass by the horizontal shift tray 28, the book-bound sheet-bundle SC is transferred. In this case, an angle a between the rotation tray 27 and the horizontal shift tray is 15 degrees or less so that the book-bound sheet-bundle SC is not subjected to great bending load, thereby preventing the book-bound bundle from distorting.

Figure 14:
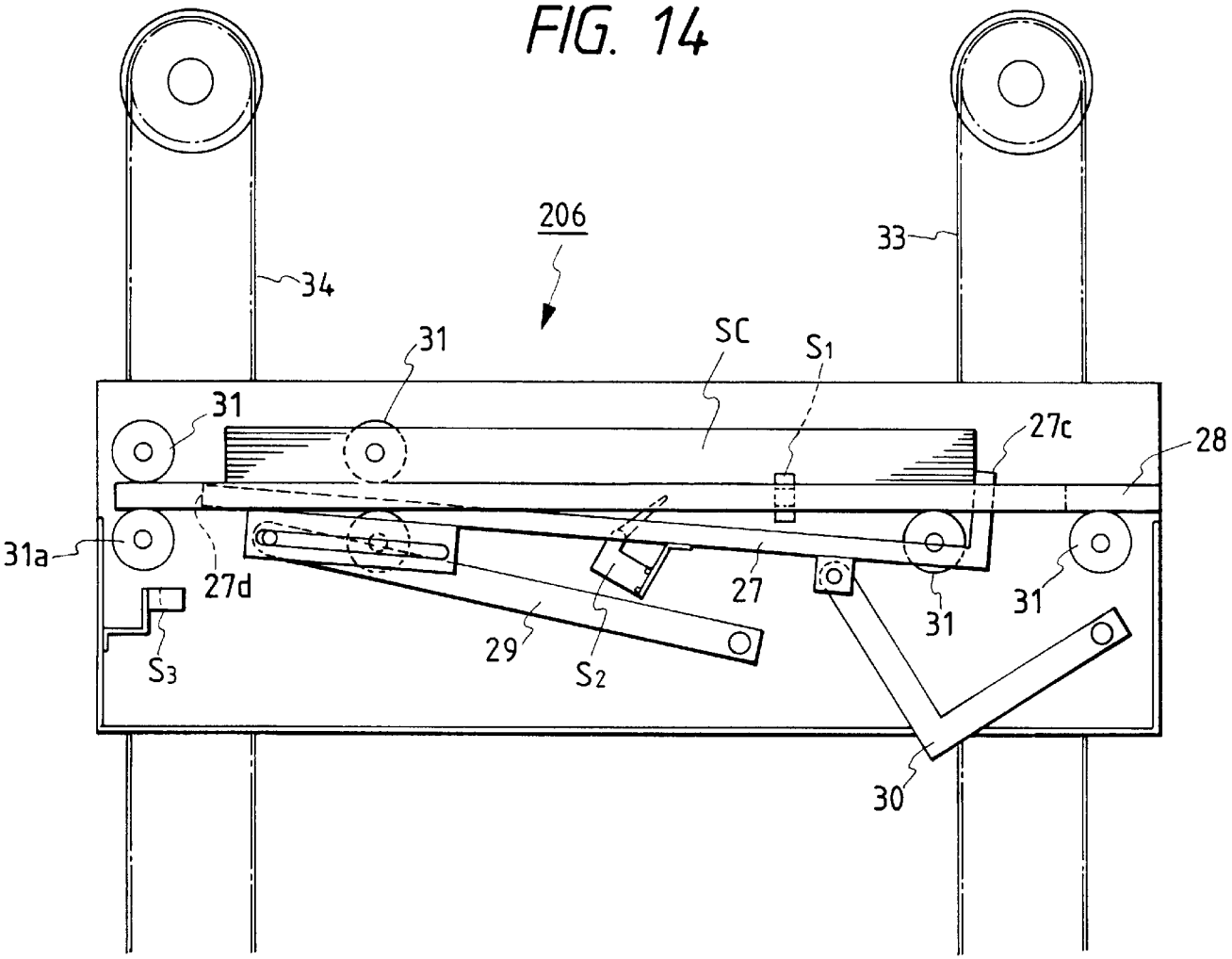
FIG. 14 is a front view showing a condition that the sheet-bundle is being conveyed to the horizontal shift tray.

When the rotation trays 27 are further lowered, before the abutment portion 27*c* of the rotation tray 27 is lowered below the horizontal shift tray 28, the rear end portion 27*d* of the rotation tray is lowered below the horizontal shift tray 28, as shown in FIG. 14 (in FIG. 14, the abutment member 70 is not shown). As a result, since the book-bound sheet-bundle SC is regulated until the book-bound sheet-bundle SC is brought to the horizontal condition by the abutment member 27*c*, the tip end portion of the book-bound sheet-bundle SC is not deviated, thereby always maintaining the drop point of the book-bound sheet-bundle constant.

Figure 15:
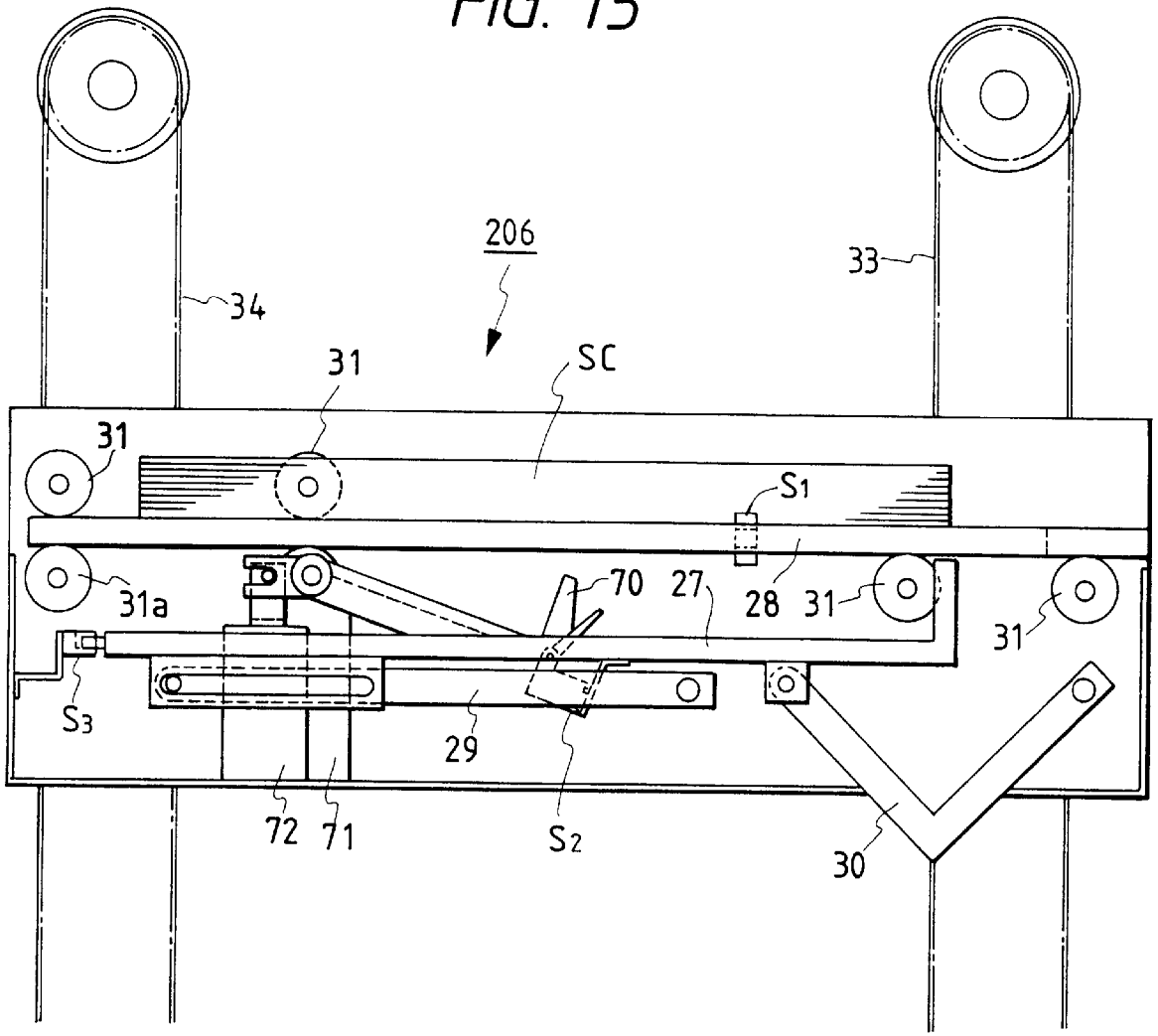
FIG. 15 is a front view showing a condition after the sheet-bundle is conveyed to the horizontal shift tray.
Figure 16:
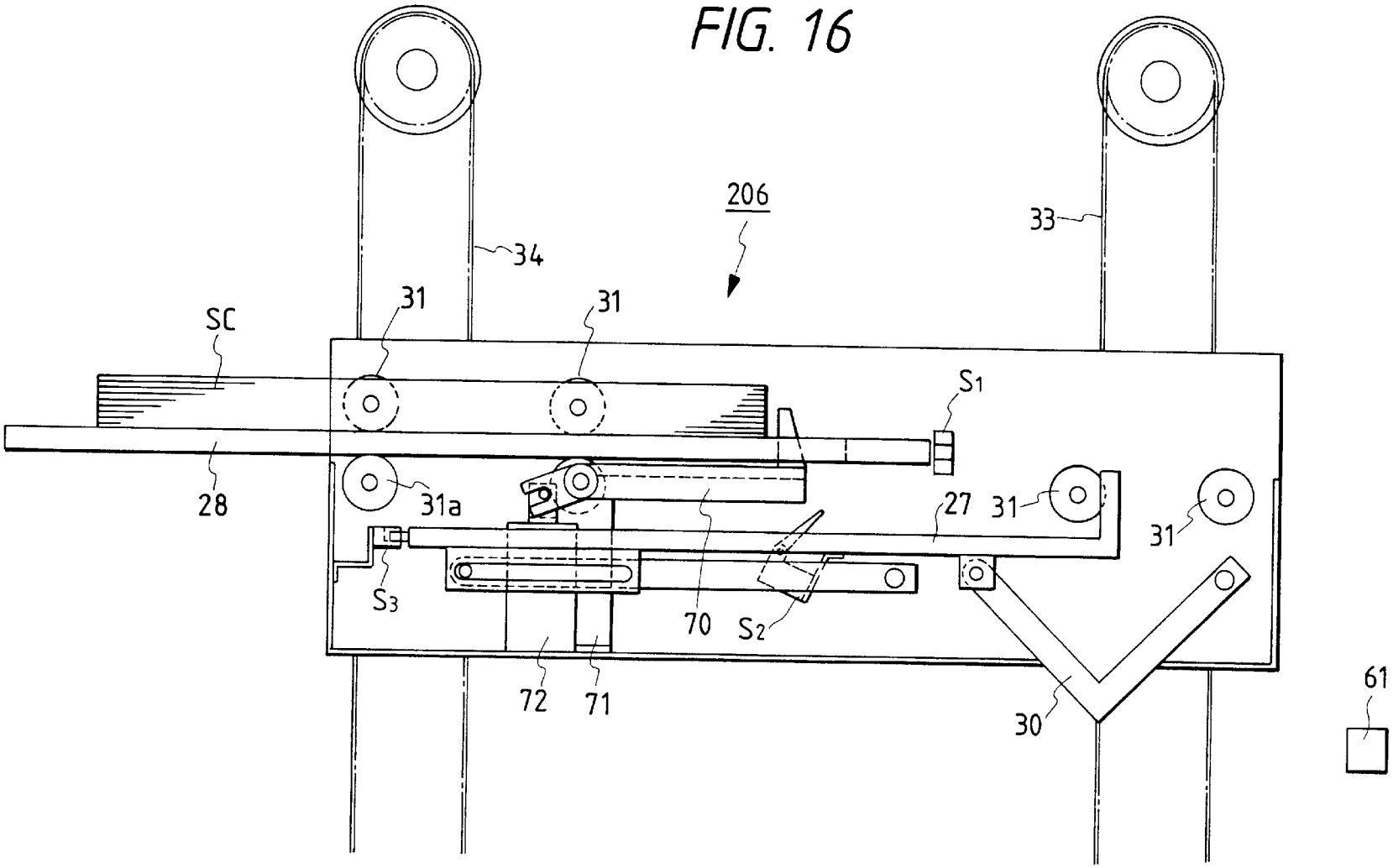
FIGS. 16 and 17 are front views for explaining the operation of the rotation tray.
Figure 17:
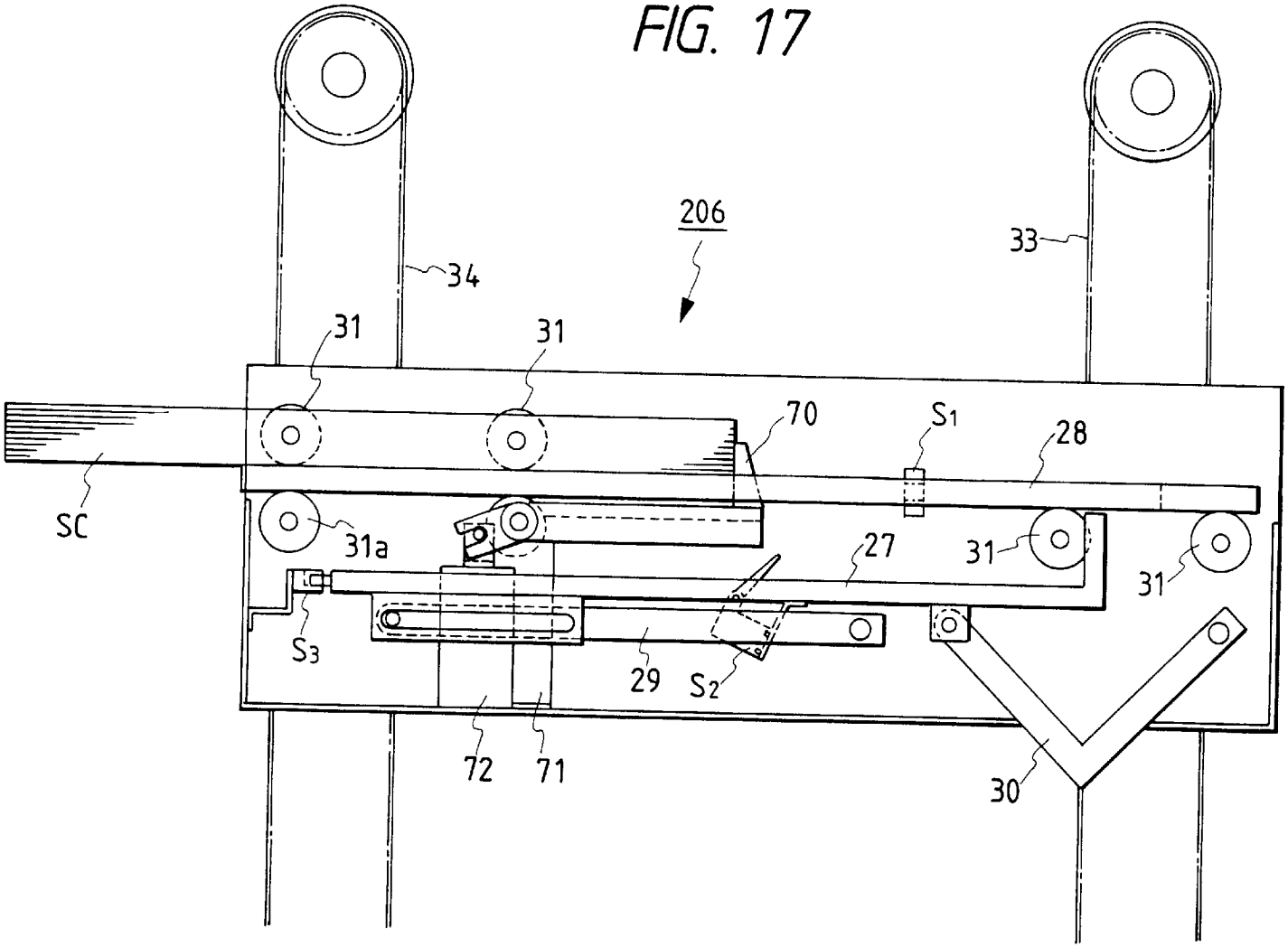
Figure 18:
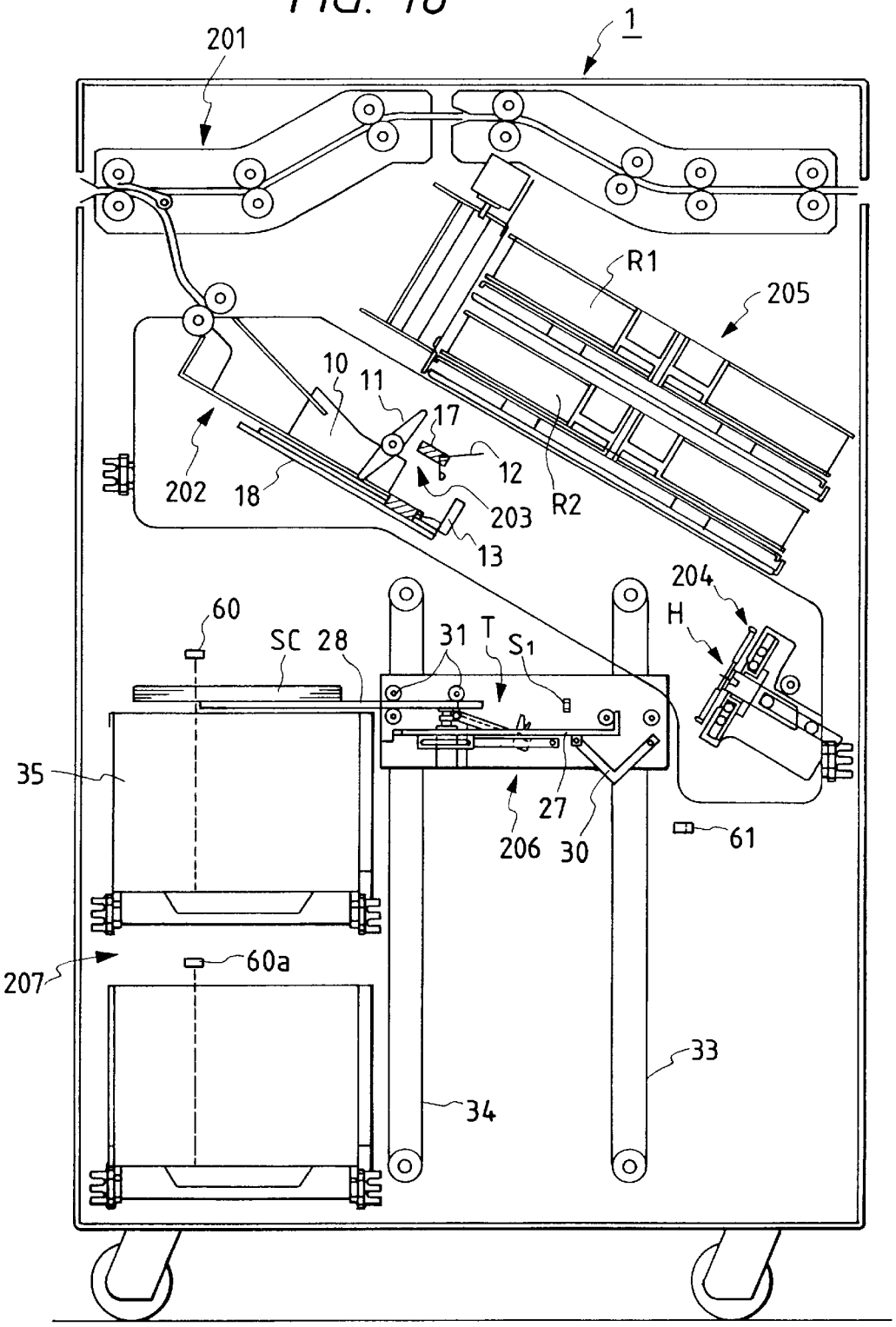
FIGS. 18 and 19 are elevational sectional views of a bookbinding apparatus, showing an operation of the horizontal shift tray.

FIG. 15 shows a condition that the rotation trays 27 are returned to the home position and the book-bound sheet-bundle SC is completely transferred onto the horizontal shift tray 28. Then, in a position (FIGS. 16 and 18) where the book-bound bundle conveying apparatus 206 is lifted from the home position (home position sensor 61) by 50 mm, by rotating the pulse motor by a predetermined amount, the horizontal shift tray 28 is shifted to the left by a predetermined amount, and the abutment means 70 is lifted by the solenoid 72 to protrude it above the horizontal shift tray (FIG. 16). Then, by shifting the horizontal shift tray 28 to the right, the book-bound sheet-bundle SC abuts against the abutment means 70, with the result that the phase between the book-bound sheet-bundle SC and the horizontal shift tray 28 is deviated (FIG. 17). That is to say, the sheet-bundle is shifted on the tray 28. By further shifting the horizontal shift tray 28 to the left, the book-bound sheet-bundle SC can be protruded above (introduced into) the stacker (FIG. 18).

Figure 19:
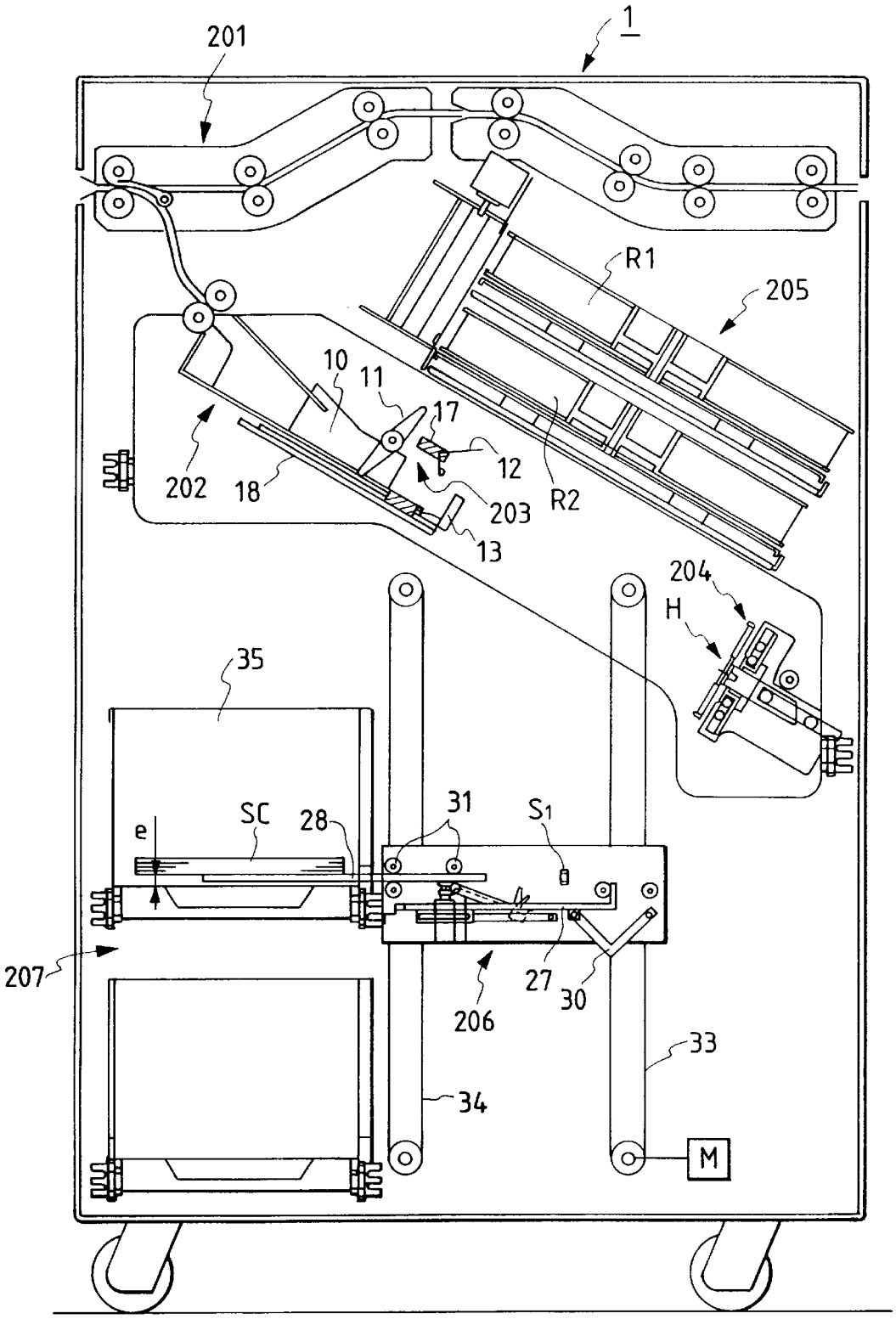

By effecting the conveyance of the sheet-bundle by using such an abutment means 70, the shifting amount of the sheet-bundle can be increased without increasing the length of the horizontal shift tray. A stacking height of the book-bound bundle is previously calculated by a distance sensor 60 for detecting stacking height of the book-bound bundle to calculate a lowering distance of the stacker 35. As shown in FIG. 18, the lowering distance e of the book-bound sheet-bundle SC (distance to the bottom of the stacker 35) is preferably selected to be e<20 mm, and, in the illustrated embodiment, e=15 mm (FIG. 19).

Figure 20:
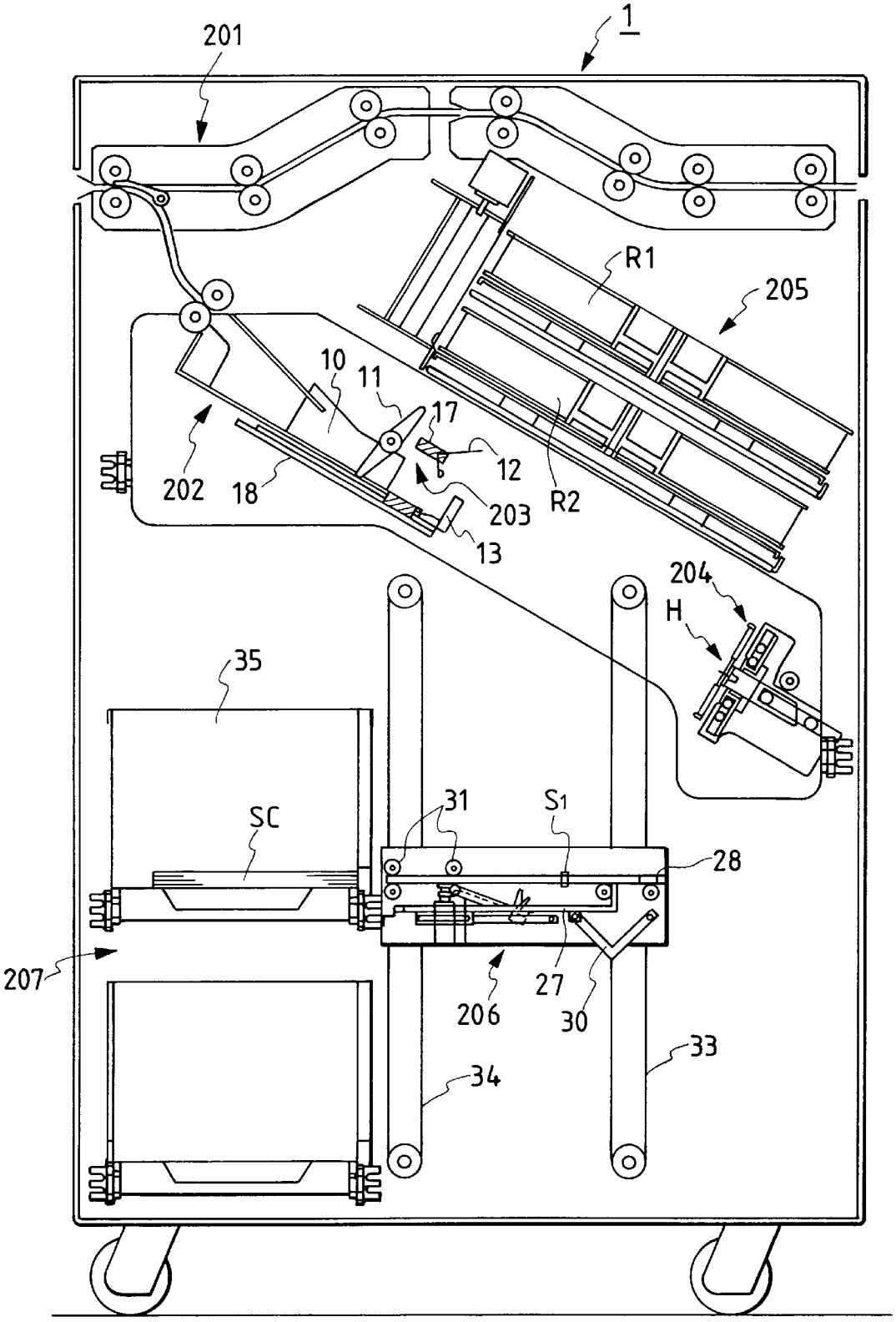
FIG. 20 is an elevational sectional view of the bookbinding apparatus, showing a condition after the sheet-bundle is contained in the stacker by shifting the horizontal shift tray.

The book-bound bundle conveying apparatus 206 is lifted or lowered by driving the timing belts 34, 33 by the rotation of the stepping motor 14. In the illustrated embodiment, the book-bound bundle conveying apparatus is suspended by the four timing belts, and the horizontal condition of the book-bound bundle conveying apparatus 206 is maintained by applying tension to the apparatus. With this arrangement, since holding means such as slide rails can be omitted, the installation space can be saved and the apparatus can be made cheaper. Then, the book-bound sheet-bundle SC is rested on the stacker 35 by retracting the horizontal shift tray 28 to the right. In this case, although the book-bound sheet-bundle SC is dropped by about 15 mm and the bending load acts on the sheet-bundle, the book-bound sheet-bundle is not distorted to generate misalignment of the sheet bundle (FIG. 19). FIG. 20 shows a condition that the book-bound sheet-bundle is completely contained in the stacker 35.

Incidentally, in the condition shown in FIG. 15, the tray 28 may be shifted to the right to shift the sheet-bundle by pushing the sheet-bundle.

Next, an embodiment of the present invention including partial modifications will be explained with reference to FIGS. 21 and 22. Since this modified embodiment differs from the former embodiment only in the point of a sensor 80 of reflection type and other components are the same as those of the former embodiment, such same elements are designated by the same reference numeral and explanation thereof will be omitted.

Figure 21:
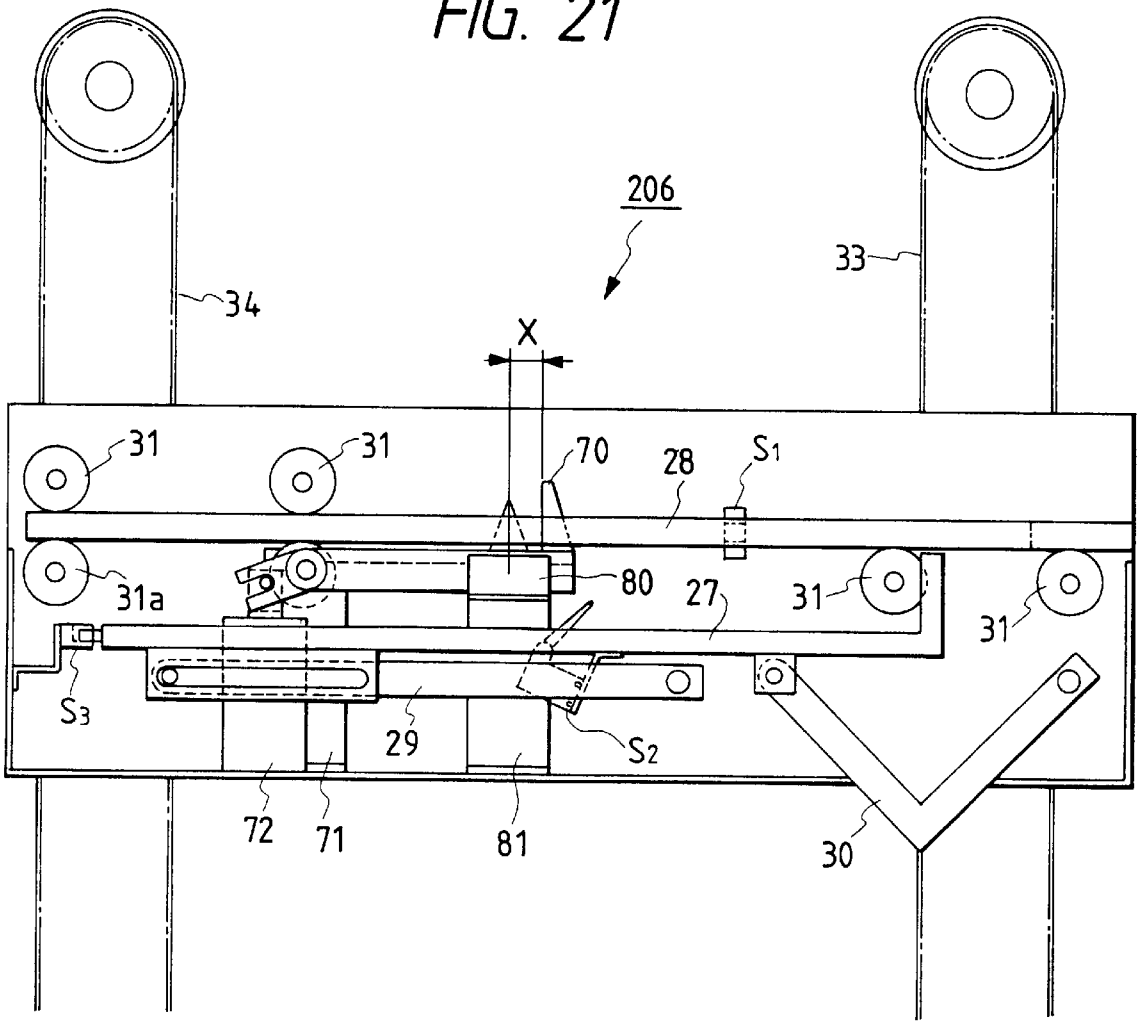
FIG. 21 is an elevational sectional view of a sheet-bundle conveying apparatus according to an embodiment wherein a sheet-bundle rear end detecting means is provided.
Figure 22:
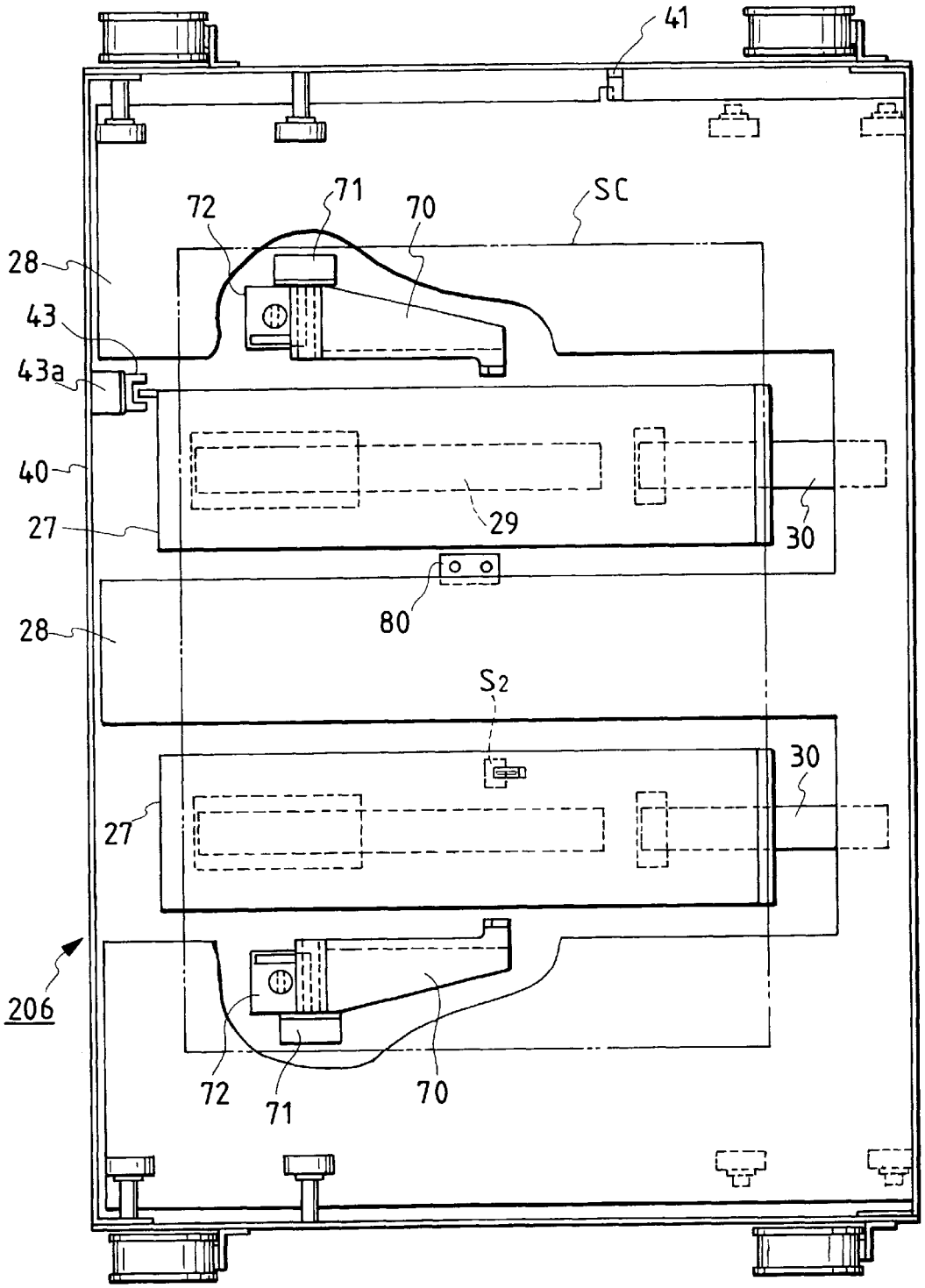
FIG. 22 is a top view of the apparatus of FIG. 21.

As shown in FIG. 21, a photo-sensor of reflection type (sheet-bundle rear end detection means) 80 is positioned below the horizontal shift tray 28 and is disposed between the horizontal shift tray and the rotation trays 27. When the rear end of the sheet-bundle is detected, a detection signal is sent to the control means P.

With the arrangement as mentioned above, after the book-bound sheet-bundle SC is transferred to the onto the horizontal shift tray 28, the horizontal shift tray 28 is shifted to the left. In this case, in the former embodiment, while an example that the horizontal shift tray is shifted by controlling the number of steps of the motor was explained, in this modified embodiment, after the rear end of the book-bound sheet-bundle is detected by the sensor 80 of reflection type, the horizontal shift tray 28 is stopped by the control means P, thereby protruding the abutment means 70 upwardly. As a result, a distance between the rear end of the book-bound sheet-bundle and the abutment means 70 can be decreased more than the former embodiment, thereby further making the apparatus compact.

Figure 23:
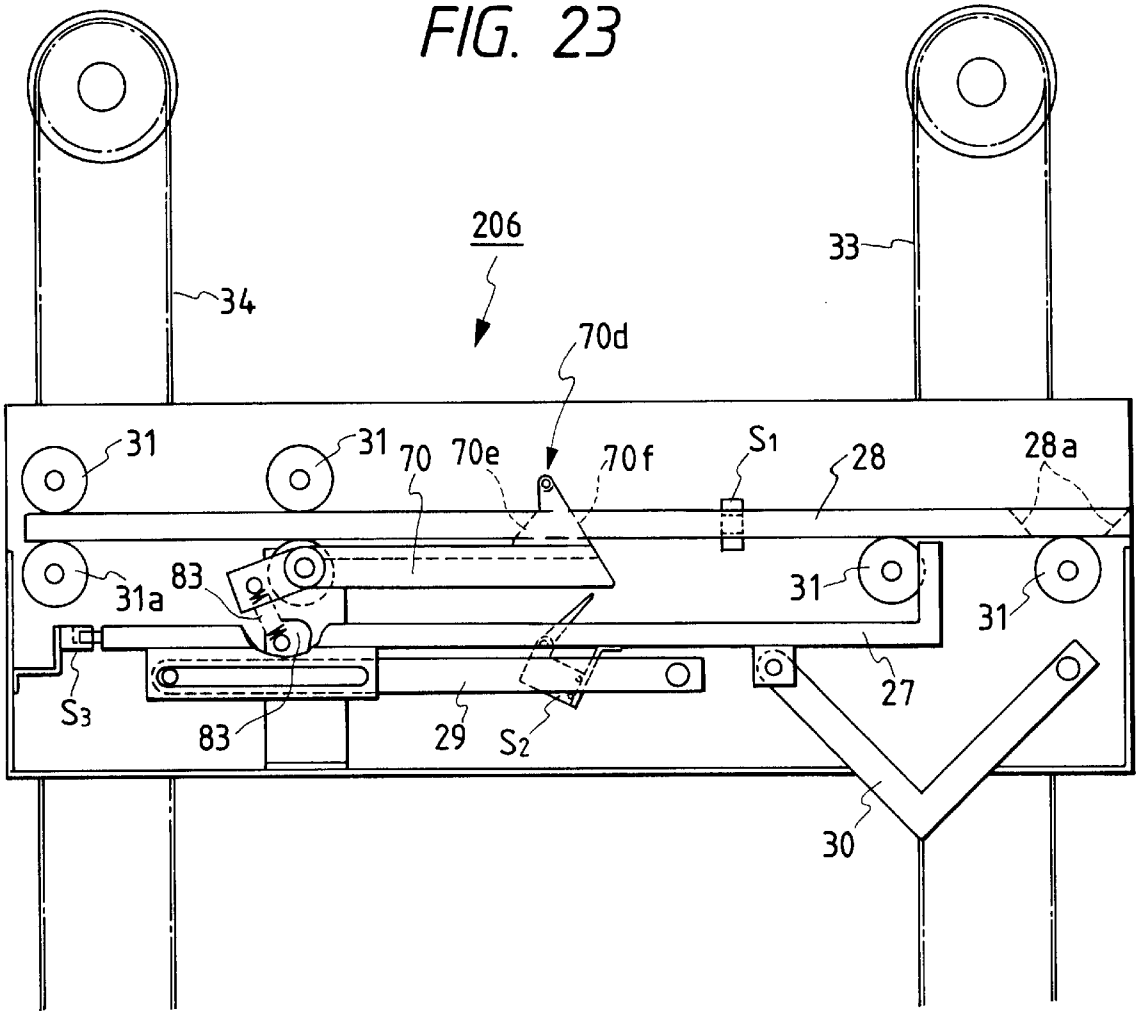
FIG. 23 is an elevational sectional view of a sheet-bundle conveying apparatus according to an embodiment wherein an embodiment means is partially modified.

Next, a further modified embodiment will be explained with reference to FIG. 23. Incidentally, since this further modified embodiment differs from the former embodiment only in the point of a shape of the abutment means 70 and other components are the same as those of the former embodiment, the same elements are designated by the same reference numeral and explanation thereof will be omitted.

The abutment means 70 is biased by a biasing means 83. The reference numeral 70*d* denotes a free rotating roller; 70*e*, 70*f* denote inclined portions corresponding to the inclined portion 28*a* of the horizontal shift tray 28. When the book-bound sheet-bundle is transferred from the rotation trays 27 to the horizontal shift tray 28, the abutment means 70 is rotated downwardly by the weight of the book-bound sheet-bundle SC in opposition to the biasing means 83. Then, as the horizontal shift tray 28 is shifted to the left, after the rear end of the rear end of the book-bound sheet-bundle has just passed the roller 70*d*, the abutment means 70 is rotated by the biasing means 83 to protrude upwardly. Then, the horizontal shift tray 28 is shifted to the right, thereby effecting the out-of-phase. When the horizontal shift tray 28 is greatly shifted to the left, the abutment means 70 is urged downwardly by the inclined portion 28*a*.

As mentioned above, in the sheet-bundle conveying method according to the present invention, by independently driving the rotation trays on which the sheet bundle is rested and the horizontal shift tray for conveying the sheet bundle from the rotation trays to the containing portion, the apparatus can be made cheaper and compact. Further, since sheet-bundle conveying steps can be made simpler to ensure the stable operation, working ability and image quality can be improved.

Further, in the sheet conveying apparatus according to the present invention, the sheet-bundle can stably be conveyed by conveying the sheet-bundle while resting the sheet-bundle on the horizontal shift tray. By stopping the sheet-bundle by the abutment means, the relative position between the sheet-bundle and the horizontal shift tray can be deviated. Thus, since the sheet-bundle can be shifted by a longer distance than the shifting amount of the horizontal shift tray, the horizontal shift tray can be made compact.

By reciprocally shifting the horizontal shift tray on which the sheet-bundle was rested, by detecting the rear end of the sheet-bundle by the rear end detection means, by stopping the reciprocal movement of the horizontal shift tray in association with the abutment means, and by protruding the abutment means upwardly, it is possible suppress the reciprocal movement of the horizontal shift tray to be optimum amount, thereby reducing the length of the horizontal shift tray in the reciprocal direction. Further, by reducing the unwanted movement of the horizontal shift tray, the apparatus can be made even more compact and cheaper.

When the sheet-bundle is transferred from the rotation trays to the horizontal shift tray, the positional deviation of the sheet-bundle can be corrected by effecting the relative deviation between the abutment means and the horizontal shift tray, with the result that the rear end of the sheet-bundle is urged against the abutment means, thereby permitting the correction of the deviation of the sheet-bundle and correctly controlling the shifting amount of the sheet-bundle. Further, even if the posture of the sheet-bundle is inclined, since the posture is naturally corrected by effecting out-of-phase by using two or more abutment means, thereby achieving the stable conveyance of the sheet-bundle.

Further, when the horizontal shift tray is shifted, since the abutment means are urged below the horizontal shift tray by abutting against the inclined portion, even when the abutment means is always protruded above the biasing means, the reciprocal movement of the horizontal shift tray is not obstructed without any drive source. Further, when the sheet-bundle is rested on the horizontal shift tray, the abutment means is urged downwardly by the weight of the sheet-bundle, and, when the horizontal shift tray is shifted and the rear end of the sheet-bundle passes through the abutment means, the abutment means is protruded upwardly.

Then, when the horizontal shift tray is shifted, the sheet-bundle is stopped, thereby effecting the positional deviation between the sheet-bundle and the horizontal shift tray. With this arrangement, a drive source for the abutment means can be omitted, thereby making the apparatus compact and cheaper.

In the bookbinding apparatus according to the present invention, since the non-bound sheet-bundle is conveyed while gripping the sheet-bundle by the grippers, the sheet-bundle is not distorted by substantial external force. Although the book-bound sheet-bundle is not pinched, since the sheet-bundle is rested on the tray so that the sheet-bundle is conveyed while widely supporting at its lower surface, the stable sheet-bundle conveyance can be achieved. In this way, by providing the conveying means suitable for the condition of the sheet-bundle, there is provided a bookbinding apparatus having a relatively simple sheet-bundle conveying apparatus. Further, by effecting the positional deviation by using the abutment means, since the position on which the sheet-bundle is rested can be controlled, by providing the sheet-bundle conveying means suitable for the condition of the sheet-bundle, the economical bookbinding apparatus can be achieved.

What is claimed is:

1. A sheet-bundle conveying apparatus comprising:

a shift tray on which a sheet-bundle is rested and which is laterally shiftable;

a containing means for containing the sheet-bundle shifted by said shift tray; and a shift means for changing a relative position between said shift tray and the sheet-bundle rested on said shift tray so that the sheet-bundle is shifted toward said containing means;

wherein said shift tray is shifted toward said containing means such that the sheet-bundle is shifted to thereby cause the sheet-bundle to reach said containing means.

2. A sheet-bundle conveying apparatus according to claim 1, wherein said shift means includes a stop means for restraining the sheet-bundle rested on said shift tray, and when said shift tray is returned in the opposite direction, the sheet-bundle is restrained by said stop means, to thereby shift the sheet-bundle.

3. A sheet-bundle conveying apparatus according to claim 2, wherein the shifting of said shift tray in the opposite direction is effected on the way that said shift tray is shifted to said containing means.

4. A sheet-bundle conveying apparatus according to claim 3, wherein said stop means includes an abutment means which is lifted above said shift tray by an electrically-operated means when the sheet-bundle reaches a predetermined position.

5. A sheet-bundle conveying apparatus according to claim 4, wherein whether the sheet-bundle reaches the predetermined position is judged by using the number of steps of a pulse motor for controlling the shifting of said shift tray.

6. A sheet-bundle conveying apparatus according to claim 4, wherein whether the sheet-bundle reaches the predetermined position is judged by judging whether the passage of the sheet-bundle by a photo-sensor.

7. A sheet-bundle conveying apparatus according to claim 3, wherein said stop means includes an abutment means which is elastically lifted above said shift tray when the sheet-bundle passes through said abutment means.

8. A sheet-bundle conveying apparatus according to claim 7, wherein said abutment means is lowered below said shift tray by a weight of the sheet-bundle.

9. A sheet-bundle conveying apparatus according to claim 1, wherein said means containing includes a stacker having a bottom and a comb-like side wall, and said shift tray has a comb-like configuration which is lowered in the comb-like side wall of said stacker, and, after the sheet-bundle is caused to reach said stacker, said shift tray is lowered, and then is shifted in the opposite direction while containing the sheet-bundle in said stacker.

10. A sheet-bundle conveying apparatus according to claim 9, further comprising a rock tray having a comb-like configuration capable of passing the combs of said shift tray, said rock tray being rocked downwardly after receiving the sheet-bundle at an operation position, to thereby retain the sheet-bundle on said shift tray.

11. A sheet-bundle conveying apparatus according to claim 4, wherein said containing means includes a stacker having a bottom and a comb-like side wall, and said shift tray has a comb-like configuration which is lowered in the comb-like side wall of said stacker, and, after the sheet-bundle is caused to reach said stacker, said shift tray is lowered, and then is shifted in the opposite direction while containing the sheet-bundle in said stacker.

12. A sheet-bundle conveying apparatus according to claim 11, further comprising a rock tray having a comb-like configuration capable of passing the combs of said shift tray, said rock tray being rocked downwardly after receiving the sheet-bundle at an operation position, to thereby retain the sheet-bundle on said shift tray.

13. A sheet-bundle conveying apparatus according to claim 7, wherein said means containing includes a stacker having a bottom and a comb-like side wall, and said shift tray has a comb-like configuration which is lowered in the comb-like side wall of said stacker, and, after the sheet-bundle is caused to reach said stacker, said shift tray is lowered, and then is shifted in the opposite direction while containing the sheet-bundle in said stacker.

14. A sheet-bundle conveying apparatus according to claim 13, further comprising a rock tray having a comb-like configuration capable of passing the combs of said shift tray, said rock tray being rocked downwardly after receiving the sheet-bundle at an operation position, to thereby remain the sheet-bundle on said shift tray.

15. A sheet-bundle conveying apparatus according to claim 1, wherein said containing means includes a sheet stacker.

16. A sheet-bundle conveying apparatus according to claim 15, wherein said shift means includes a stop means for restraining the sheet-bundle rested on said shift tray, and when sid shift tray is returned in the opposite direction, the sheet-bundle being restrained by said stop means, to thereby shift the sheet-bundle.

17. A sheet-bundle conveying apparatus according to claim 16, wherein the shifting of said shift tray in the opposite direction is effected in the way that said shift tray is shifted to said sheet stacker.

18. A bookbinding apparatus comprising:

a binding means for binding a sheet bundle;

a shift tray on which the sheet-bundle is rested and which is laterally shiftable;

a containing means for containing the sheet-bundle shifted by said shift tray; and a shift means for changing a relative position between said shift tray and the sheet-bundle is shifted toward said containing means; and wherein said shift tray is shifted toward said containing means such that the sheet-bundle is shifted to thereby cause the sheet-bundle to reach said containing means.

19. A sheet-bundle conveying method wherein a shift tray on which a sheet-bundle rests is shifted laterally from a resting position to a containing position to cause the sheet-bundle to reach a stacker, and is lowered to a stack position, and then is shifted laterally in an opposite direction, to thereby rest the sheet-bundle in the stacker, said method compromising the steps of:

temporarily returning the shift tray laterally in the opposite direction;

restraining the sheet-bundle while said shift tray is being shifted laterally;

relatively shifting the sheet-bundle on said shift tray toward the containing position; and shifting said shift ray laterally until the sheet-bundle is caused to reach said stacker.

20. A bookbinding method wherein a sheet-bundle is stapled, and a shift tray on which the stapled sheet-bundle rests is shifted laterally from a resting position to a containing position to cause the sheet-bundle to reach a stacker, and is lowered to a stack position and then is shifted laterally in an opposite direction to thereby rest the sheet-bundle in the stacker, said method comprising the steps of:

temporarily returning the shift tray laterally in the opposite direction;

restraining the sheet-bundle while said shift tray is being shifted laterally;

relatively shifting the sheet-bundle on said shift tray toward the containing position; and shifting said shift tray laterally until the sheet-bundle is caused to reach said stacker.

* * * * *

UNITED STATES PATENT AND TRADEMARK OFFICE

CERTIFICATE OF CORRECTION

PATENT NO. : 5,964,459

DATED : October 12, 1999

INVENTOR(S) : YUJI YAMANAKA

It is certified that error appears in the above-identified patent and that said Letters Patent is hereby corrected as shown below:

COLUMN 7:

Line 45, "to the" should be deleted.

COLUMN 9:

Line 60, "whether" should be deleted.

COLUMN 11:

Line 14, "ray" should read --tray--.

Signed and Sealed this

Sixth Day of March, 2001

Nicholas P. Godici

*Attest:*

NICHOLAS P. GODICI

*Attesting Officer*

*Acting Director of the United States Patent and Trademark Office*